US009188408B2

(12) United States Patent
Huynh

(10) Patent No.: US 9,188,408 B2
(45) Date of Patent: Nov. 17, 2015

(54) AUTO-LOCKING ADJUSTMENT DEVICE

(75) Inventor: Xuyen Huynh, Hillsboro, OR (US)

(73) Assignee: LEUPOLD & STEVENS, INC., Beaverton, OR (US)

( * ) Notice: Subject to any disclaimer, the term of this patent is extended or adjusted under 35 U.S.C. 154(b) by 823 days.

(21) Appl. No.: 12/938,981

(22) Filed: Nov. 3, 2010

(65) Prior Publication Data

US 2011/0100152 A1 May 5, 2011

Related U.S. Application Data

(60) Provisional application No. 61/258,190, filed on Nov. 4, 2009.

(51) Int. Cl.

| | |
|---|---|
| ***G05G 5/12*** | (2006.01) |
| ***G05G 1/10*** | (2006.01) |
| ***F41G 1/38*** | (2006.01) |
| ***F41G 1/22*** | (2006.01) |

(52) U.S. Cl.

CPC ... *F41G 1/22* (2013.01); *F41G 1/38* (2013.01); *G05G 1/10* (2013.01); *Y10T 74/2084* (2015.01); *Y10T 74/20474* (2015.01)

(58) Field of Classification Search

CPC ..... F41G 1/22; F41G 1/54; F41G 1/38; F41A 33/02; G05G 5/03; G05G 1/082; Y10T 74/2084

USPC ..... 74/504, 813 L, 553; 42/119, 126; 359/821; 70/214

See application file for complete search history.

(56) References Cited

U.S. PATENT DOCUMENTS

| | | | | |
|---|---|---|---|---|
| 793,087 | A * | 6/1905 | McVitty | 70/214 |
| 1,344,973 | A | 6/1920 | Bader | |
| 2,143,167 | A | 1/1939 | Pechar | |
| 2,165,796 | A | 7/1939 | Humeston | |
| 2,208,913 | A | 7/1940 | Unertl | |
| 2,229,637 | A | 1/1941 | Burton | |
| 2,336,107 | A | 12/1943 | Litschert | |
| 2,452,592 | A | 11/1948 | Meyer | |
| 1,583,042 | A | 1/1952 | Dayton | |
| 2,585,933 | A | 2/1952 | Harvey | |
| 2,682,707 | A | 7/1954 | Folke | |
| 2,913,826 | A | 11/1959 | Petty | |
| 3,037,287 | A | 6/1962 | Glatz et al. | |
| 3,058,391 | A | 10/1962 | Leupold | |
| 3,161,716 | A | 12/1964 | Burris et al. | |
| 3,206,238 | A | 9/1965 | Speight et al. | |
| 3,222,987 | A | 12/1965 | Wrigglesworth | |

(Continued)

FOREIGN PATENT DOCUMENTS

| | | | | |
|---|---|---|---|---|
| CN | 2752794 Y | | 1/2006 | |
| DE | 803698 | * | 4/1951 | 74/557 |

(Continued)

OTHER PUBLICATIONS

PTO Translation of DE 803698, Ernst, Apr. 1951.*

(Continued)

*Primary Examiner* — Vinh Luong
(74) *Attorney, Agent, or Firm* — Stoel Rives LLP

(57) ABSTRACT

A dial for adjusting an adjustable portion of a device includes an actuator that moves substantially transverse to an axis of rotation to unlock the dial for rotation. When the actuator is released, the dial automatically locks in place.

25 Claims, 22 Drawing Sheets

(56) References Cited

U.S. PATENT DOCUMENTS

| | | | | |
|---|---|---|---|---|
| 3,280,463 | A | 10/1966 | Stadler | |
| 3,297,389 | A | 1/1967 | Gibson | |
| 3,471,932 | A | 10/1969 | Luning | |
| 3,662,618 | A | 5/1972 | Kroll et al. | |
| 3,707,204 | A | 12/1972 | Dussardier | |
| 3,826,012 | A | 7/1974 | Packmayr | |
| 3,910,308 | A * | 10/1975 | Mack | 137/553 |
| 3,916,721 | A | 11/1975 | Egger | |
| 3,990,155 | A | 11/1976 | Akin, Jr. et al. | |
| 3,999,442 | A | 12/1976 | Decker et al. | |
| 4,012,966 | A | 3/1977 | Lieberman et al. | |
| 4,026,397 | A | 5/1977 | Raus | |
| 4,038,757 | A | 8/1977 | Hicks et al. | |
| 4,132,129 | A | 1/1979 | Pratt | |
| 4,154,125 | A | 5/1979 | Frank | |
| 4,200,355 | A | 4/1980 | Williams, Jr. | |
| 4,201,096 | A | 5/1980 | Morrison et al. | |
| 4,247,161 | A | 1/1981 | Unertl, Jr. | |
| 4,347,758 | A | 9/1982 | Geil et al. | |
| 4,373,269 | A | 2/1983 | Doliber et al. | |
| 4,389,791 | A | 6/1983 | Ackerman | |
| 4,397,107 | A * | 8/1983 | Holden | 42/126 |
| 4,408,842 | A | 10/1983 | Gibson | |
| 4,457,076 | A | 7/1984 | Heck | |
| 4,461,330 | A | 7/1984 | Judkins | |
| 4,643,542 | A | 2/1987 | Gibson | |
| 4,779,305 | A | 10/1988 | Gorsek | |
| 4,955,253 | A | 9/1990 | Sakai et al. | |
| 4,982,502 | A | 1/1991 | Weyrauch | |
| 5,020,389 | A | 6/1991 | Sigler | |
| 5,083,477 | A | 1/1992 | Geil | |
| 5,121,653 | A | 6/1992 | Sigler | |
| 5,152,187 | A | 10/1992 | LaFemina | |
| 5,329,829 | A | 7/1994 | Sell | |
| 5,363,559 | A | 11/1994 | McCarty | |
| 5,433,010 | A | 7/1995 | Bell | |
| 5,499,456 | A | 3/1996 | Tomita | |
| 5,513,440 | A | 5/1996 | Murg | |
| 5,586,569 | A | 12/1996 | Hanning et al. | |
| 5,615,487 | A | 4/1997 | Tomita | |
| 5,618,374 | A | 4/1997 | Byerley | |
| 5,695,125 | A | 12/1997 | Kumar | |
| 5,715,607 | A | 2/1998 | Murg | |
| 5,745,287 | A | 4/1998 | Sauter | |
| 5,771,595 | A | 6/1998 | Bell | |
| 5,862,715 | A | 1/1999 | Lemire | |
| 5,892,617 | A | 4/1999 | Wallace | |
| 5,906,141 | A | 5/1999 | Abdelmoula | |
| 5,930,934 | A | 8/1999 | Fisher et al. | |
| 6,005,711 | A | 12/1999 | Mai et al. | |
| 6,279,259 | B1 | 8/2001 | Otteman | |
| 6,351,907 | B1 | 3/2002 | Otteman | |
| 6,442,854 | B1 | 9/2002 | Liu et al. | |
| 6,508,144 | B1 | 1/2003 | Vendetti et al. | |
| 6,519,890 | B1 | 2/2003 | Otteman | |
| 6,588,125 | B2 | 7/2003 | Proctor, Sr. | |
| 6,643,970 | B2 | 11/2003 | Huber | |
| 6,691,447 | B1 | 2/2004 | Otteman | |
| 6,705,037 | B2 | 3/2004 | Van Kirk | |
| 6,721,095 | B2 | 4/2004 | Huber | |
| 6,772,550 | B1 | 8/2004 | Leatherwood | |
| 6,848,628 | B2 | 2/2005 | Walker | |
| 6,860,442 | B2 | 3/2005 | Datcuk, Jr. | |
| 6,862,832 | B2 | 3/2005 | Barrett | |
| 7,117,624 | B2 | 10/2006 | Kim | |
| 7,121,037 | B2 | 10/2006 | Penney | |
| 7,330,310 | B2 | 2/2008 | Hengst et al. | |
| 7,640,830 | B2 * | 1/2010 | Bonis | 74/813 L |
| 8,270,104 | B2 * | 9/2012 | Windauer | 359/821 |
| 8,806,798 | B2 * | 8/2014 | Crispin | 42/119 |
| 2003/0140545 | A1 | 7/2003 | Huber | |
| 2004/0088898 | A1 | 5/2004 | Barrett | |
| 2006/0254115 | A1 | 11/2006 | Thomas et al. | |
| 2006/0268433 | A1 | 11/2006 | Thomas | |
| 2006/0278035 | A1 | 12/2006 | Casas | |
| 2007/0240356 | A1 | 10/2007 | Klepp et al. | |
| 2008/0066364 | A1 | 3/2008 | Klepp et al. | |
| 2008/0197642 | A1 | 8/2008 | Talpe | |
| 2008/0236018 | A1 | 10/2008 | Halverson | |
| 2009/0205461 | A1 | 8/2009 | Windauer | |
| 2013/0167425 | A1 * | 7/2013 | Crispin | 42/119 |
| 2013/0220060 | A1 * | 8/2013 | Sano | G05G 5/03 74/504 |
| 2014/0137458 | A1 * | 5/2014 | Crispin | 42/119 |
| 2014/0196351 | A1 * | 7/2014 | Campean | G05G 1/082 42/119 |

FOREIGN PATENT DOCUMENTS

| | | | | |
|---|---|---|---|---|
| DE | 2 148 967 | | 4/1973 | |
| DE | 297 20 737 | U1 | 2/1998 | |
| DE | 299 03 989 | U1 | 6/1999 | |
| DE | 20301749 | U1 | 4/2003 | |
| DE | 102 22 528 | A1 | 12/2003 | |
| DE | 202006003770 | U1 | 7/2006 | |
| DE | 102008045232 | * | 4/2010 | G05G 1/105 |
| GB | 598306 | | 2/1948 | |
| GB | 708438 | | 5/1954 | |
| GB | 1102022 | | 2/1968 | |
| GB | 1214584 | | 12/1970 | |
| GB | 2213959 | A | 8/1989 | |
| JP | 11-085290 | A | 3/1999 | |
| WO | WO 2006/060490 | A2 | 6/2006 | |
| WO | WO 2006/109587 | A1 | 10/2006 | |

OTHER PUBLICATIONS

EPO Machine Translation of DE102008045232, Bjoern et al., Apr. 2010.*

"Bayonet Mount," http:www.answers.com/topic/bayonet-mount, 2 pp., Sep. 28, 2006.

International Search Report, PCT/US05/43336, 7 pp., Jun. 16, 2008.

Notice of Allowance, U.S. Appl. No. 11/720,428, Apr. 22, 2011.

* cited by examiner

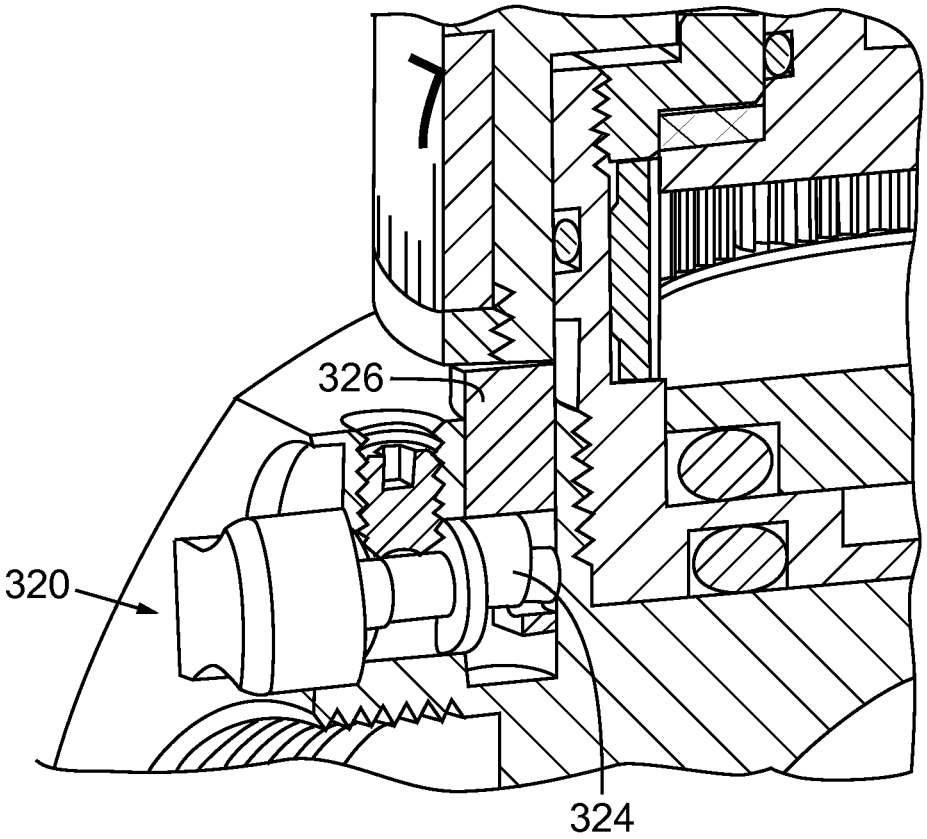
FIG. 8
FIG. 9
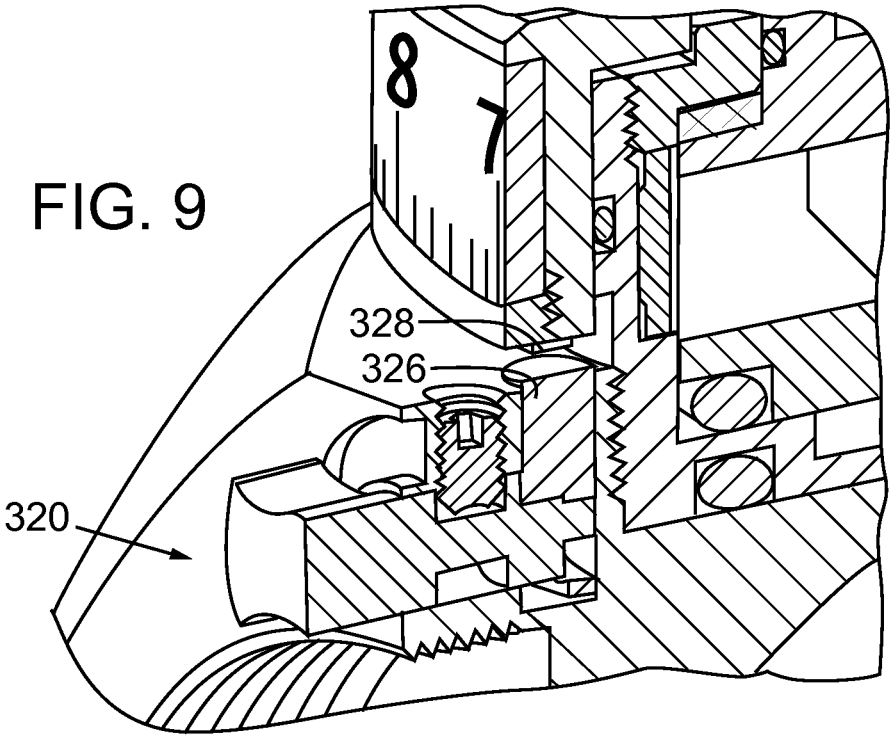

AUTO-LOCKING ADJUSTMENT DEVICE

RELATED APPLICATIONS

This application claims priority under 35 U.S.C. §119(e) to U.S. Patent Application No. 61/258,190 titled "Pinch-To-Turn Auto-Locking Adjustment" filed on Nov. 4, 2009, which is incorporated by reference herein.

TECHNICAL FIELD

The field of the present disclosure relates to automatically-locking (auto-locking) devices used to make adjustments.

BACKGROUND

Rotatable adjustment knobs, or dials, are commonly used to make adjustments to an adjustable portion of a device such as an optical or electrical device. For example, rotatable dials are commonly used to adjust an elevation setting and a windage setting for a riflescope or other suitable weapon aiming device. Rotatable dials are also used to adjust other features of riflescopes, binoculars, spotting scopes, or other suitable optical device, such as parallax, focus, illumination brightness, or other suitable feature. Other examples of rotatable dials used to adjust an adjustable portion of a device include volume control dials, channel selection dials, and other suitable dials.

The present inventor has recognized that in many applications it would be advantageous for an adjustment knob or dial to automatically lock in place, thus helping ensure that the setting selected by a user remains set despite accidental forces imparted to the knob or dial, for example, during transit or other handling. Others have attempted to create knobs that lock in place. U.S. Patent Application Publication No. 2009/0205461 A1 describes one such knob that requires a user to grasp the knob while imparting a secondary motion such as pulling or pushing in order to rotate the knob.

SUMMARY

In one embodiment, an adjustment mechanism includes an actuator that moves substantially transverse to an axis of rotation to unlock the adjustment mechanism for rotation. When the actuator is released, the adjustment mechanism automatically locks in place.

Preferred adjustments include elevation or windage adjustments to a sighting device, weapon aiming device, riflescope, spotting scope, or other optical device, but disclosed auto-locking devices may be used in other mechanical or electrical devices for making a volume, channel, or station selection, or other suitable mechanical, electrical, or electronic adjustment.

The auto-locking devices described herein help prevent unintentional adjustments and otherwise help to keep an adjustment locked while a device is used, transported, or otherwise handled. For example, the auto-locking devices help prevent accidental changes to the elevation or windage adjustments when a user transports a sighting device or places the sighting device in a storage case.

The present inventor has recognized that a knob or dial manipulated by a user with a natural grasping and rotating motion, such as pinching a knob or dial between a thumb and finger and rolling the dial between the thumb and finger, without requiring additional manipulation may facilitate ease of use and may be intuitive to use.

According to one embodiment, an auto-locking dial for adjusting a portion of an optical device comprises a fixed portion non-rotatably attached to the optical device; an engagement surface non-rotatably attached to the fixed portion; and a rotatable portion rotatable about an axis of rotation and rotatably coupled to the fixed portion for rotation with respect to the engagement surface, wherein the rotatable portion includes a mechanical arrangement that rotates with the rotatable portion for driving an adjustment member. The auto-locking dial also comprises an adjustment member operatively connected to the adjustable portion of the optical device, wherein the adjustment member is operatively connected to the mechanical arrangement such that rotation of the rotatable portion about the axis of rotation causes the adjustment member to adjust the adjustable portion of the optical device; and a locking mechanism carried by the rotatable portion, the locking mechanism including a link moveable along the axis of rotation and an engagement member, wherein the engagement member contacts the engagement surface to prevent rotation of the rotatable portion with respect to the engagement surface when the link is in a lock position, and facilitates rotation of the rotatable portion with respect to the engagement surface when the link is in an unlock position. A biasing element arranged to bias the link into the lock position; and an actuator moveably coupled to the rotatable portion, wherein the actuator is configured to (a) move relative to the rotatable portion substantially transverse to the axis of rotation and (b) to engage a portion of the link to cause movement of the link along the axis of rotation toward the unlock position when an external force is applied to move the actuator are also included.

Additional aspects and advantages will be apparent from the following detailed description of preferred embodiments, which proceeds with reference to the accompanying drawings.

BRIEF DESCRIPTION OF THE DRAWINGS

FIGS. 8 and 9 are enlarged cross-sectional views of the auto-locking device of FIG. 7 illustrating additional details of the adjustment stop.

DETAILED DESCRIPTION OF PREFERRED EMBODIMENTS

With reference to the above-listed drawings, this section describes particular embodiments and their detailed construction and operation. The embodiments described herein are set forth by way of illustration only and not limitation. Those skilled in the art will recognize in light of the teachings herein that there is a range of equivalents to the example embodiments described herein. Most notably, other embodiments are possible, variations can be made to the embodiments described herein, and there may be equivalents to the components, parts, or steps that make up the described embodiments.

For the sake of clarity and conciseness, certain aspects of components or steps of certain embodiments are presented without undue detail where such detail would be apparent to those skilled in the art in light of the teachings herein or where such detail would obfuscate an understanding of more pertinent aspects of the embodiments.

In one embodiment, an auto-locking device is actuated by squeezing or radially pinching two buttons that are rotationally coupled to a dial or knob. The two buttons, in turn, move actuator shafts inward, which causes a contact or linkage to move downward along with a lock pin (which is coupled to the linkage). The lock pin includes a circumferential groove into which a portion of a clicker can enter. The downward motion of the lock pin causes the circumferential groove of the lock pin to align with the clicker, which allows the clicker (and a spindle to which the clicker is rotationally coupled) to freely rotate against a stationary lock ring, thereby allowing a threaded plunger or screw to move up or down relative to a spindle base. The auto-locking device may include an indicator, which allows the user to monitor the extent of rotation of the knob, and may permit a user to customize a knob to a particular device by replacing the indicator ring. The pinch-and-turn motion preferably allows the user to unlock the knob and make an adjustment with relative ease using a natural grasping motion, and preferably allows the user to avoid performing multiple separate motions (e.g., grasp, pull-up and turn or grasp, push-down and turn) to make an adjustment.

Figure 1:
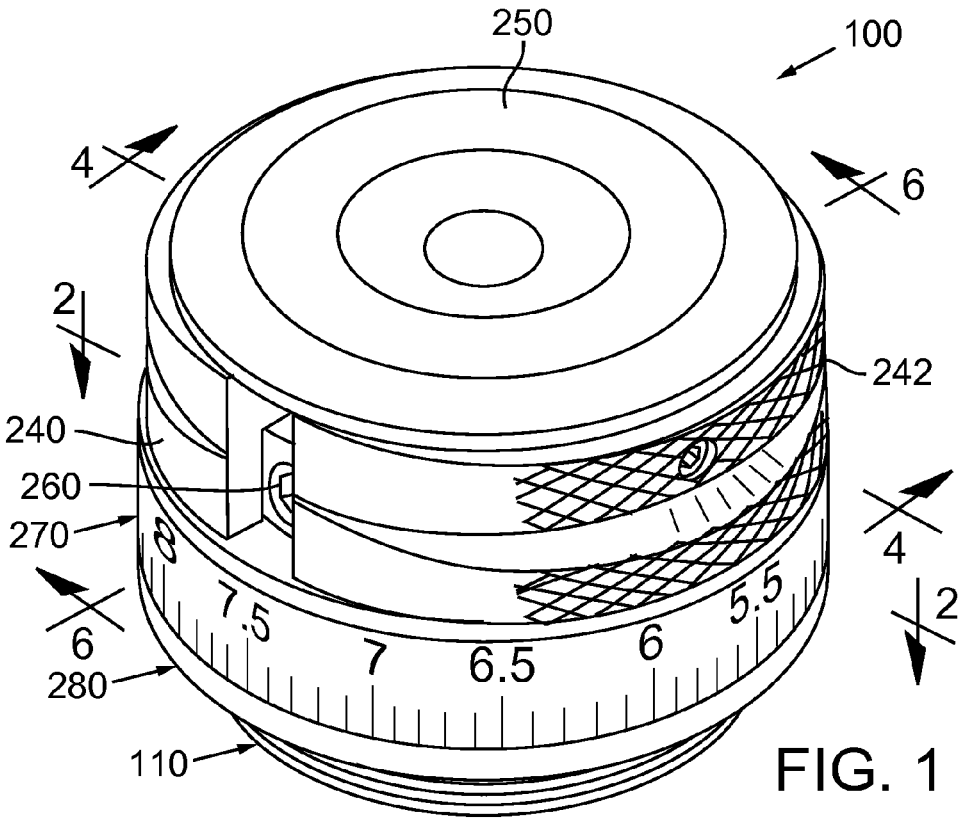
FIG. 1 is a perspective view of an auto-locking device, according to one embodiment.
Figure 2:
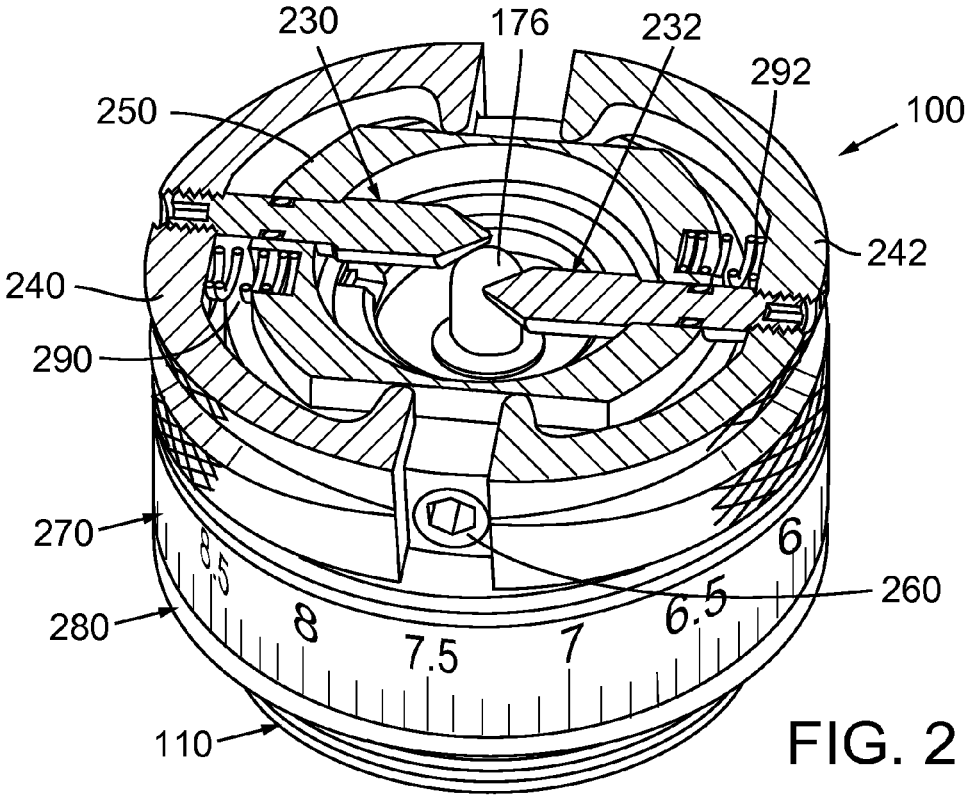
FIG. 2 is a cross-sectional view of the auto-locking device of FIG. 1 taken along line 2-2.
Figure 3:
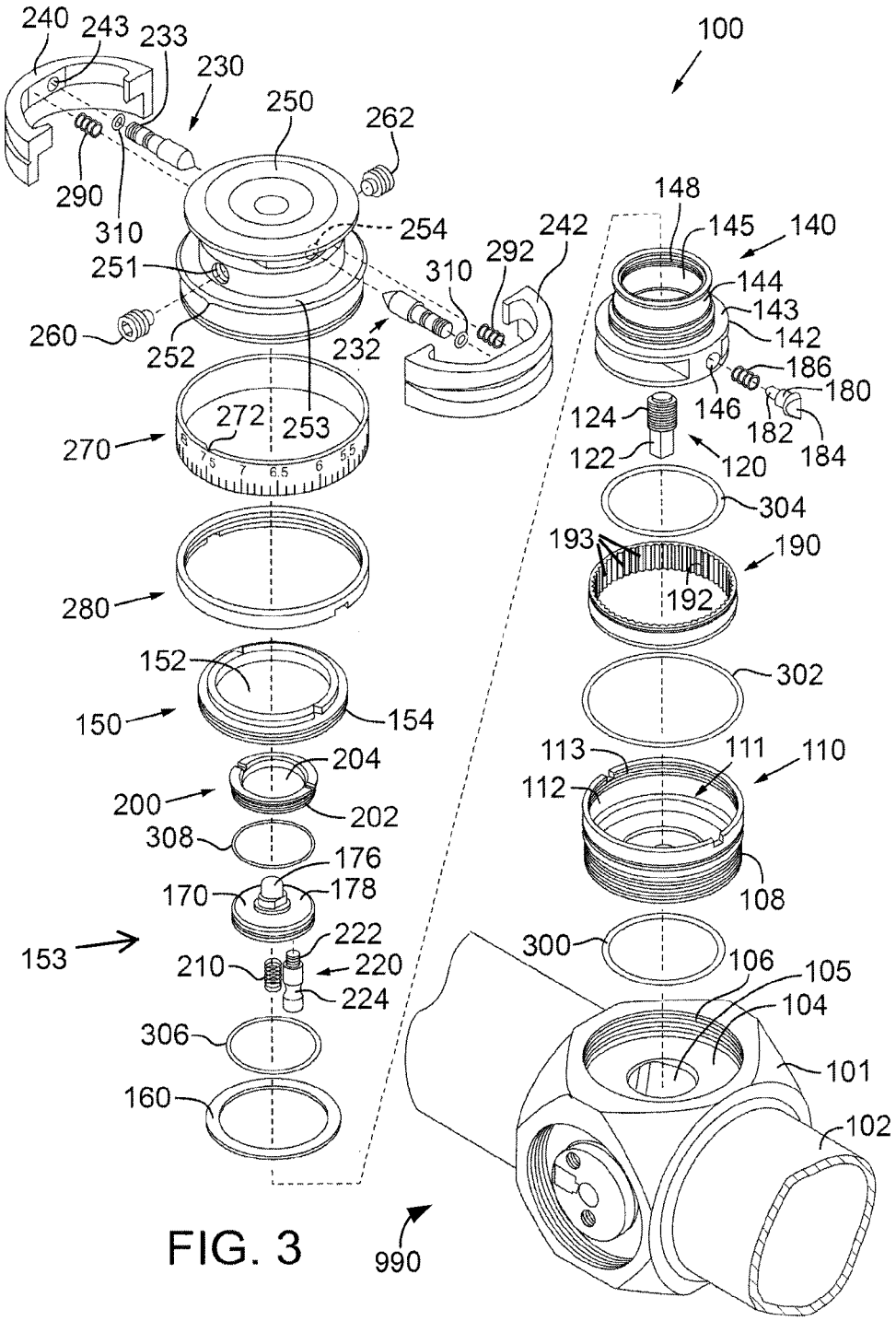
FIG. 3 is an exploded view of the auto-locking device of FIG. 1.

FIGS. 1-5 illustrate various views of an auto-locking device 100, according to another embodiment. FIG. 4A illustrates another embodiment. As shown in FIG. 3, the auto-locking device 100 is mounted to a main tube 102 of an optical device 990 depicted as a riflescope. While the following description is made with reference to a riflescope, the auto-locking device 100 may be used with other devices, including optical devices such as binoculars, spotting scopes or other sighting devices, weapon aiming devices, microscopes, or other suitable optical devices. In addition, although the following description is made with reference to a single auto-locking device 100, the riflescope may include additional auto-locking devices 100 as adjustment mechanisms, such as a horizontal adjustment mechanism for a windage adjustment and a vertical adjustment mechanism for an elevation adjustment. Further, although the auto-locking device 100 may be used to adjust elevation and windage, the auto-locking device 100 may be also be used for other adjustments, such as focus, magnification, illumination control, or other suitable adjustment. Still further, the auto-locking device 100 may be used with other suitable devices, such as a knob or adjustor for a microscope or telescope, a machine subjected to relatively large amounts of vibration, vehicles such as aircraft and automobiles and equipment located therein, or any other suitable device that is adjusted in whole or part by rotating an adjustment device bearing a locking mechanism.

Within the main tube 102 of the riflescope, an inner tube 103 (FIGS. 4 and 5) bearing a reticle or lens assembly may be movably mounted perpendicular to a longitudinal tube axis, for example, by a ball-and-socket joint between one end of the inner tube 103 and the main tube 102. A seat 101 is secured to a main tube 102. The seat 101 includes a bore 104 sized to receive the auto-locking device 100. The bore 104 preferably includes threads 106 formed on an interior wall or shoulder of the bore 104 that mate with threads 108 on a spindle base 110. In some embodiments, a seat, such as seat 101, constitutes a fixed portion of an auto-locking device. In other embodiments, a base, such as spindle base 110, constitutes a fixed portion of an auto-locking device. In other embodiments, a seat and a spindle base together constitute a fixed portion of an auto-locking device. In yet other embodiments, a fixed portion of an auto-locking device may be formed as part of a device.

An aperture 105 is formed at the base of the bore 104 and is sized to receive a threaded plunger or screw 120. The plunger 120 interacts with one end of the inner tube 103 and is constrained from rotating about an axis of rotation 130 (FIG. 4) so that rotation of a spindle 140 (into which the plunger 120 is threaded) is translated into linear motion of the plunger 120 along the axis 130, thereby adjusting a position of the reticle or lens assembly (e.g., the reticle is shifted perpendicular to the tube axis). In other embodiments, plunger 120 may include a squared-off portion that interacts with a squared-off opening in main tube 102, spindle base 110, or seat 101 to prevent plunger 120 from rotating about the axis 130. In other embodiments a different mechanical arrangement may be used to move an adjustment member, such as plunger 120, for example, a crown gear arrangement or other suitable mechanism, for example, as is well known in the riflescope arts.

There are many other possible configurations for the main tube 102 and the inner tube 103 and for the optics or reticle, such as the riflescopes described in U.S. Pat. Nos. 6,279,259, 6,351,907, 6,519,890, and 6,691,447, all of which are hereby incorporated by reference in their entireties.

Figure 4:
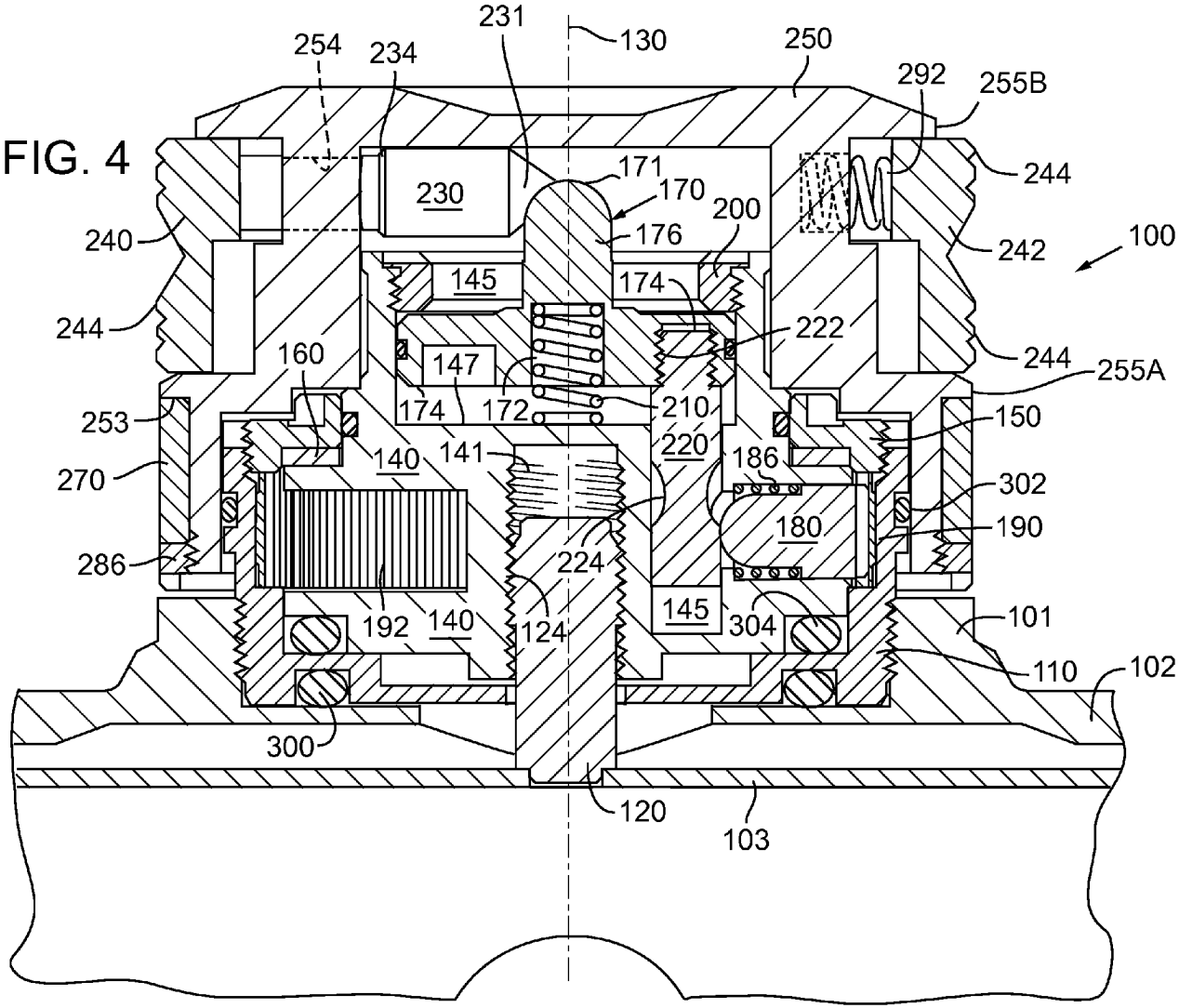
FIG. 4 is a cross-sectional view of the auto-locking device of FIG. 1 taken along line 4-4 illustrating the auto-locking device in a locked position.
Figure 4A:
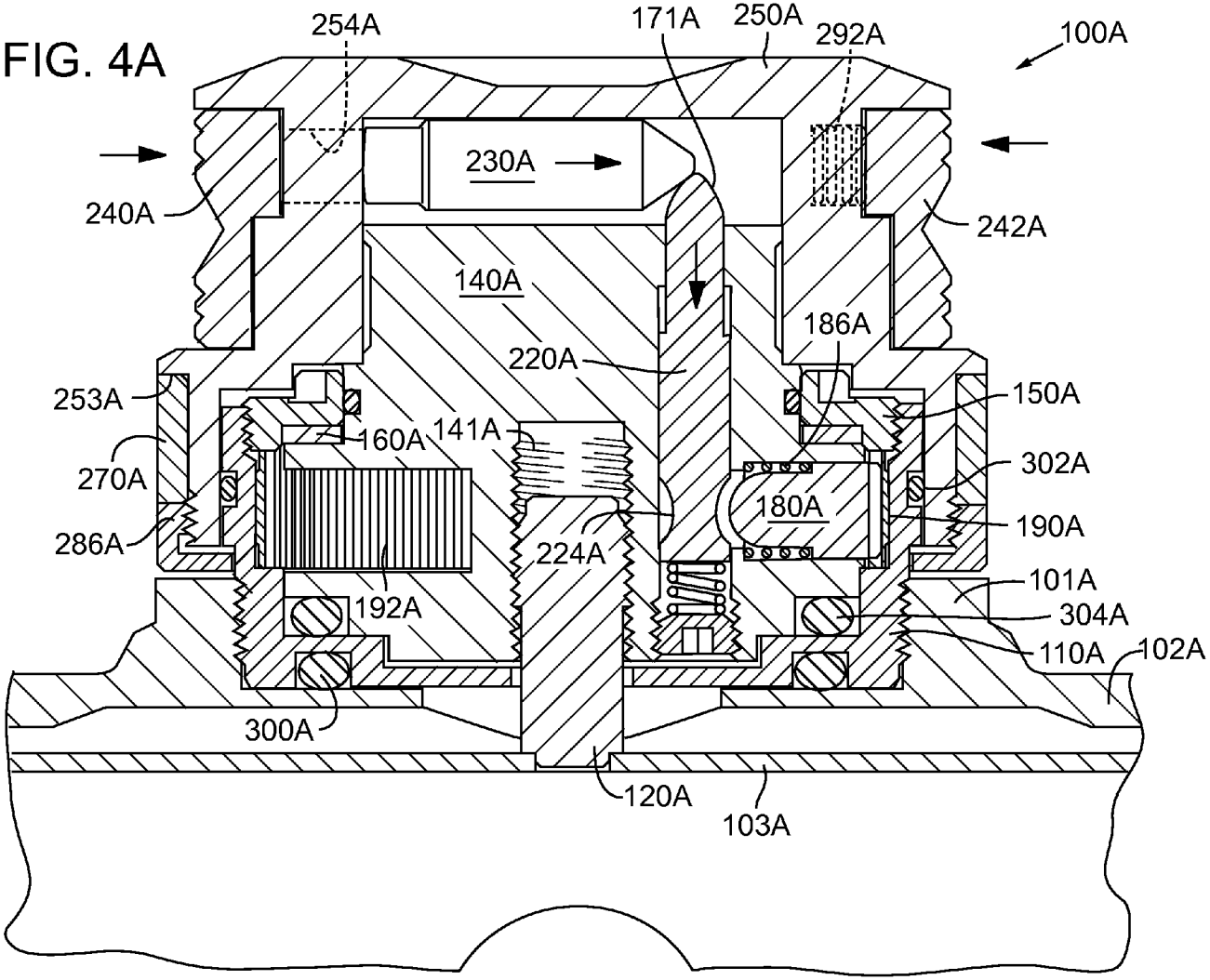
FIG. 4A is a cross-sectional view of an alternate embodiment of an auto-locking device.
Figure 5:
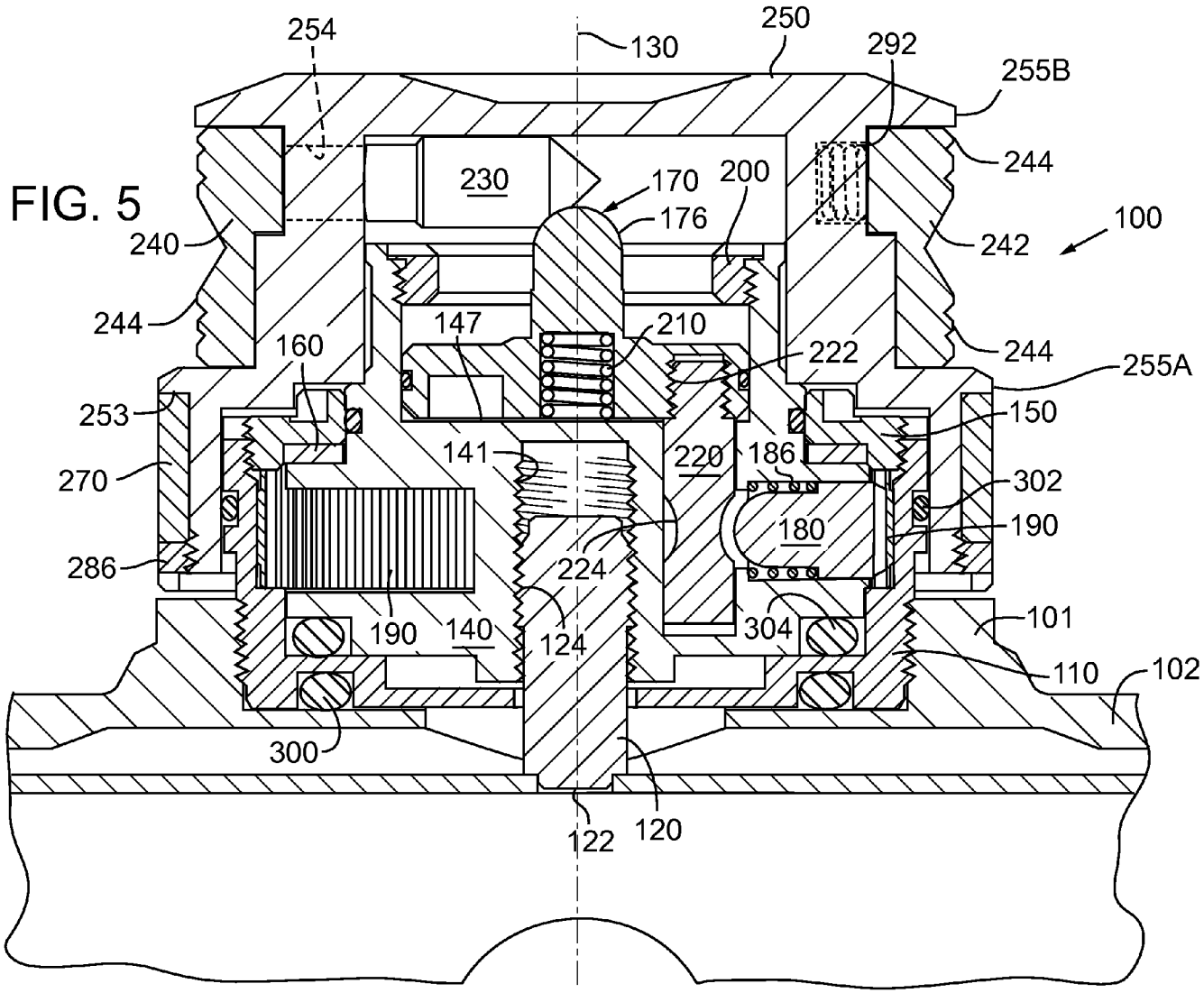
FIG. 5 is a cross-sectional view of the auto-locking device of FIG. 1 taken along line 4-4 illustrating the auto-locking device in an unlocked position.

Referring now to FIGS. 3, 4, and 5, one arrangement for constraining the plunger 120 from rotating about axis 130 includes coupling the plunger 120 to the inner tube 103. For example, a rectangular hole in the inner tube 103 may be aligned with the center of the aperture 105 and the rectangular hole may be sized to receive a keyed end 122 of the plunger 120 to prevent the adjustment plunger 120 from rotating about the axis of rotation 130. The plunger 120 may be non-rotationally coupled to the inner tube 103 in other ways, such as threaded into the inner tube 103, welded to the inner tube 103, or otherwise secured to the inner tube 103 (e.g., via an epoxy). The plunger 120 includes threads 124 at an end of the plunger 120 opposite the keyed end 122. The threads 124 are preferably sized to mesh with interior threads 141 of the spindle 140 so that the plunger 120 can be threaded into the spindle 140. Thus, rotation of the spindle 140 about the axis of rotation 130 is translated into linear motion of the plunger 120 along the axis of rotation 130, thereby adjusting a position of the inner tube 103 (and thus the reticle or optics therein). The pitch, fineness, or other attribute of threads 124 and 141 may be altered depending on the amount of adjustment desired for a corresponding amount of rotation of spindle 140. Threads 124 and 141 may not be traditional threads, but may include opposing ramped surfaces or other suitable structure for changing rotational movement of spindle 140 into linear movement of plunger 120.

The spindle 140 includes a lower base portion 142 and an upper neck portion 144, which preferably is smaller in diameter than the lower base portion 142. The lower base portion 142 of the spindle 140 is sandwiched between a flanged lock nut 150 and the spindle base 110. Thus, the spindle 140 is rotatable about the axis of rotation 130 but is constrained from traveling along the axis of rotation 130 by the flanged lock nut 150 (which is threaded into spindle base 110) and the spindle base 110 (which is threaded into the bore 104 of the main tube 102). A washer 160 may be sandwiched between a shoulder 143 of the spindle 140 and the flanged lock nut 150 to facilitate rotation of the spindle 140 within a cavity 111 of the spindle base 110. The washer 160 may be made from any suitable wear-resistant low friction material, such as nylon, polytetrafluorethylene (PTFE) polymer (e.g., Teflon®), or other suitable material. The upper neck portion 144 of the spindle 140 extends through a central aperture 152 of the flanged lock nut 150 and includes a cavity 145 (FIG. 4) into which components of a locking mechanism 153 including a contact or linkage 170 and a locking pin 220 nest. The spindle 140 also includes a bore 146 into which a clicker or wedge pin 180 extends. Additional details of the linkage 170 and the wedge pin 180 will be described in more detail below.

The spindle base 110 is threaded onto the main tube 102 so that the spindle base 110 does not rotate relative to the seat 101 as the spindle 140 rotates about the axis of rotation 130. A lock ring 190 is interposed between a shoulder 112 of the spindle base 110 and the flanged lock nut 150 and is preferably constrained from rotating about the axis of rotation 130. For example, as the outer threads 154 on the flanged lock nut 150 are threaded into the interior threads 113 of the spindle base 110, the lock ring 190 is pinched between the shoulder 112 of the spindle base 110 and the flanged lock nut 150 to thereby prevent the lock ring 190 from rotating about the axis 130. The lock ring 190 may be prevented from rotating about the axis 130 in other ways, such as being secured to the spindle base 110 (e.g., via a weld or epoxy). In addition, a pin (not shown) may extend between the spindle base 110 and the lock ring 190 to prevent rotation relative to each other. Thus, the seat 101, the lock ring 190, and the flanged lock nut 150 are anchored to the main tube 102 and are prevented from rotating about the axis 130 when the auto-locking device 100 is in a locked or unlocked position.

In a preferred arrangement, lock ring 190 includes an engagement surface 192 that faces spindle 140. The engagement surface 192 includes regularly spaced apart features, such as detents 193. The detents 193 or other engagement features may include splines or a series of evenly spaced grooves, indentations, apertures, or other suitable features that may be included on or formed in the engagement surface 192. Regularly spaced apart features preferably include ramped surfaces that facilitate a clicker or wedge pin 180 transitioning from one engagement feature to another engagement feature when spindle 140 is rotated about axis 130 as described in further detail below. Lock ring 190 therefore preferably provides an engagement surface suitable for holding a locking mechanism in place when the locking mechanism is in a locked position and suitable for providing audible clicks, tactile clicks, or both when the locking mechanism is in an unlocked position. In other arrangements, a lock ring, such as lock ring 190, may provide only an engagement surface suitable for holding a locking mechanism in place when the locking mechanism is in a locked position.

The linkage 170 is nested in a portion of the cavity 145 between a bottom surface 147 of the cavity 145 and a retaining nut 200. The retaining nut 200 is provided with outer threads 202 that mate with inner threads 148 of the neck 144 of the spindle 140. The retaining nut 200 limits the travel of the linkage 170 along the axis 130. The linkage 170 includes a bore 172 sized to receive a biasing element, such as spring 210, which is provided to bias the linkage 170 toward a locked position, for example upward (e.g., away from the bottom surface 147 of the cavity 145). In other embodiments (not shown), a locked position of linkage 170 may be proximate the bottom surface 147 and the biasing element may bias linkage 170 toward the bottom surface 147. The linkage 170 also includes an offset bore 174, which includes interior threads sized to mate with a threaded portion 222 of a locking pin 220. A protrusion 176 of the linkage 170 extends through an aperture 204 of the retaining nut 200 for interaction with a pair of actuator shafts 230 and 232. Thus, the linkage 170 is configured for movement between a first (locked) position (FIG. 4) and a second (unlocked) position (FIG. 5). The locking pin 220 travels along with the linkage 170 as the linkage 170 moves between the first and second positions along the axis 130.

The locking pin 220 includes a circumferential groove 224 into which a butt 182 of the wedge pin 180 can enter. When the locking pin 220 is positioned as shown in FIG. 4, the locking pin 220 urges an engagement portion of wedge pin 180, such as wedge portion 184, to engage the engagement surface 192, for example, by interacting with corrugations, grooves, or splines formed in the engagement surface 192 of the lock ring 190. Because butt 182 of the wedge pin 180 is misaligned from the circumferential groove 224 of locking pin 220 when in the locked position, the interaction of wedge pin 180 with the engagement surface 192 and the interaction of wedge pin 180 with spindle 140 inhibits spindle 140 from rotating with respect to the lock ring 190.

When the locking mechanism, including locking pin 220, is positioned as shown in FIG. 5 in the unlocked position, the circumferential groove 224 is aligned with the wedge pin 180. As the spindle 140 rotates about the axis of rotation 130, the wedge portion 184 of the wedge pin 180 is permitted to move with respect to the engagement surface 192, for example, because the butt 182 of the wedge pin 180 can enter the circumferential groove 224 against the bias of spring 186. The interaction of wedge pin 180 with the engagement surface 192 and the interaction of wedge pin 180 with circumferential groove 224 thus facilitates spindle 140 to rotate with respect to the lock ring 190. In preferred arrangements, the wedge pin 180 provides tactile feedback to the user as the wedge pin 180 engages and disengages regularly spaced apart features formed on or in the engagement surface 192, in other words, the user can determine an angular rotation of the spindle 140 by counting the number of clicks. In other embodiments, an engagement member, such as wedge pin 180, facilitates rotation of a rotatable portion, such as spindle 140, by not engaging an engagement surface when in the unlock position, or by selectively or intermittently engaging an engagement surface, for example, by moving out of and into spaced apart features formed in or on the engagement surface.

In the embodiment illustrated in FIGS. 1, 2, 3, 4, and 5, the assemblage of linkage 170 and locking pin 220 comprise a link that forms part of the locking mechanism. The link of FIGS. 1, 2, 3, 4, and 5 interacts with wedge pin 180 to further form part of the locking mechanism. In other embodiments the locking mechanism includes a link comprising a linkage, such as linkage 170, a locking pin, such as locking pin 220, and a stopping element, such as wedge pin 180. In other embodiments, the locking mechanism includes a link comprising a linkage, such as linkage 170, a locking pin, such as locking pin 220, a stopping element, such as wedge pin 180, and an engagement surface 192. In yet other embodiments, a link may include a linkage and a locking pin that are formed as one item.

Figure 6:
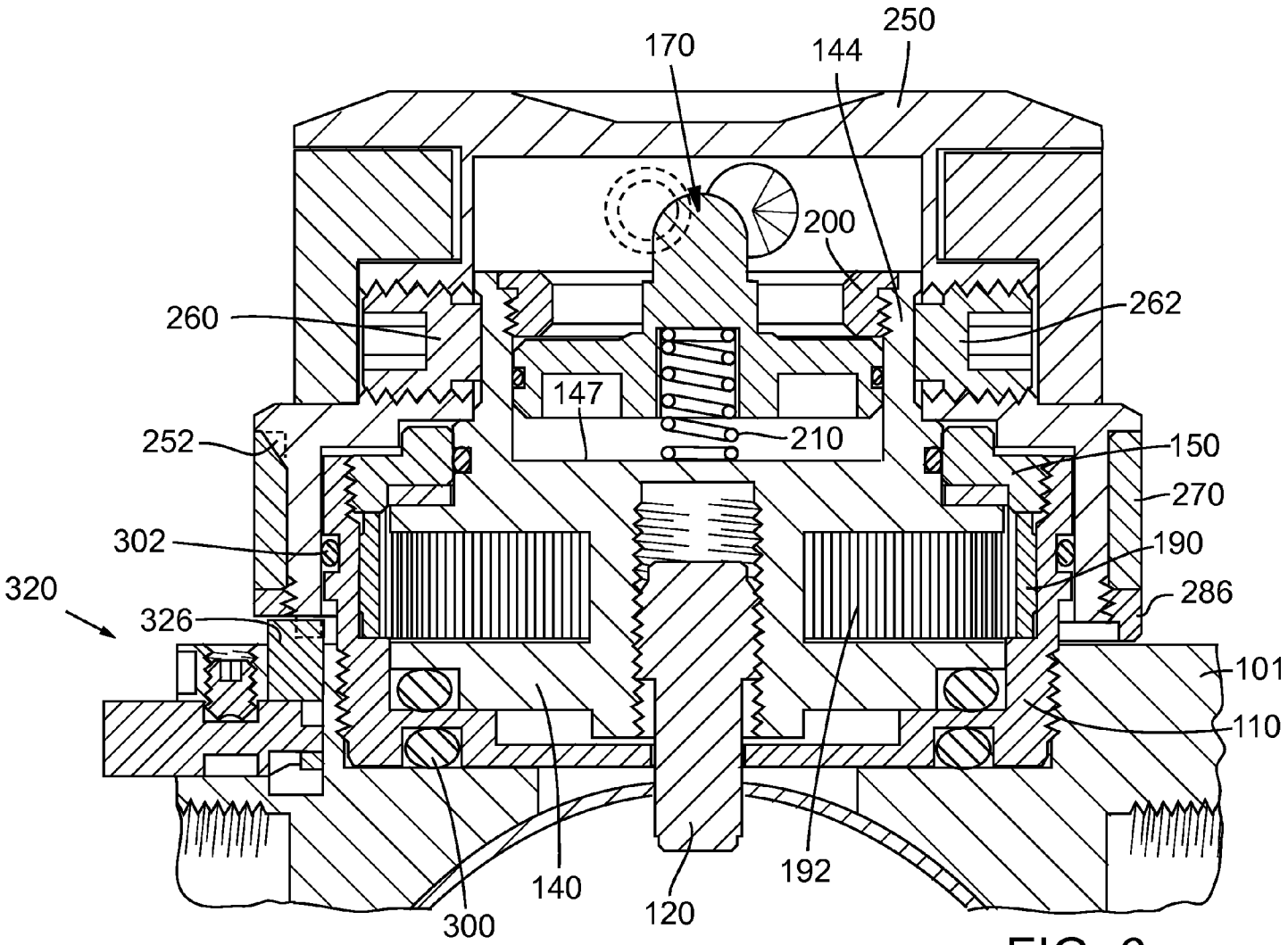
FIG. 6 is a cross-sectional view of the auto-locking device of FIG. 1 taken along line 6-6.
Figure 7:
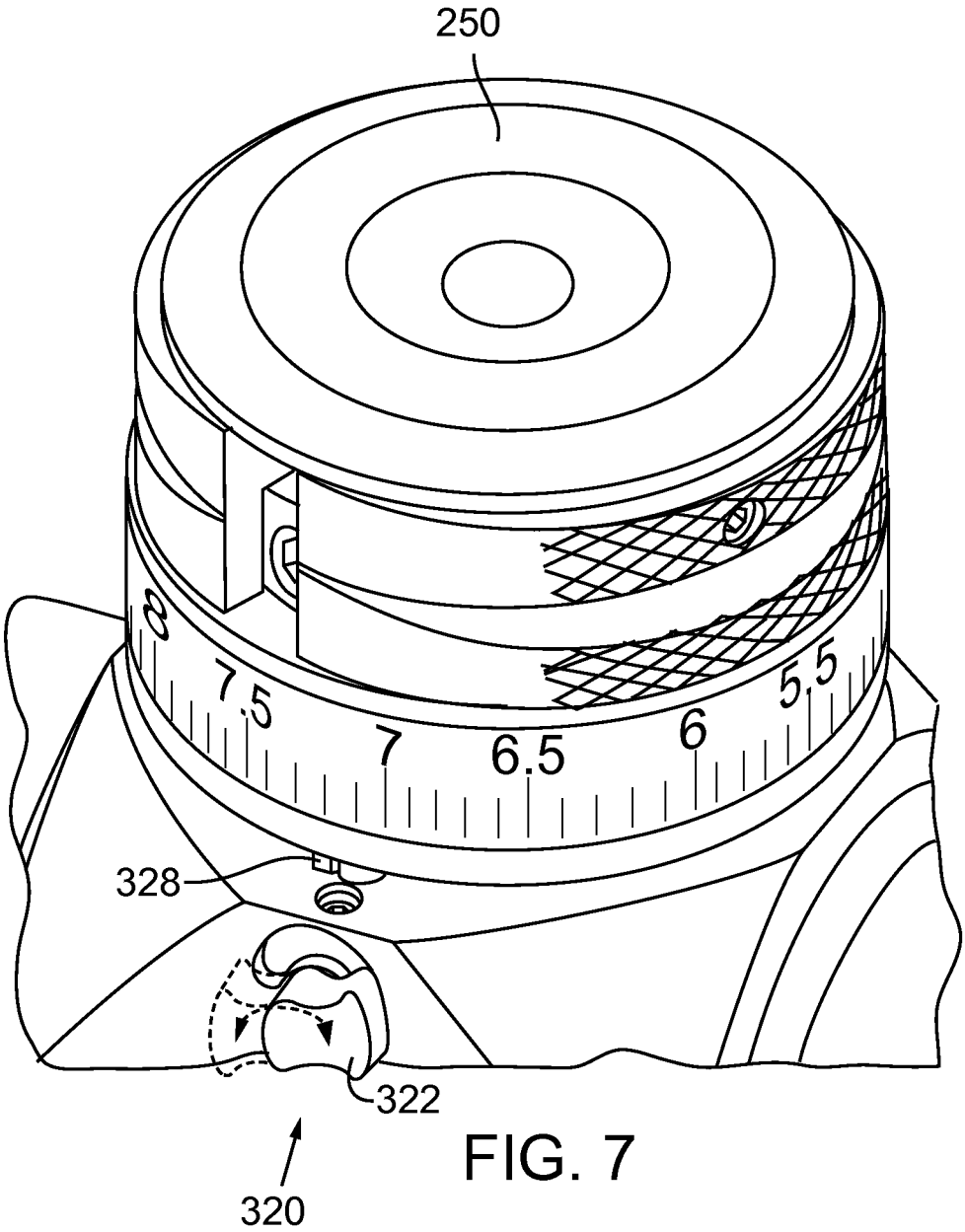
FIG. 7 is a perspective view of an auto-locking device including an adjustment stop, according to one embodiment.

A knob 250 is installed over the spindle 140 and the spindle base 110. In some embodiments, a rotatable portion of a dial constitutes a spindle, such as spindle 140, and a knob, such as knob 250. In other embodiments a rotatable portion of a dial constitutes either a spindle or a knob. The knob 250 includes a set of opposed threaded bores 251 sized to receive a pair of threaded set screws 260 and 262. Any number of set screws may be provided around the axis 130. As illustrated in FIG. 6, the set screws 260 and 262 rotationally couple the knob 250 to the neck 144 of the spindle 140. A tool, such as a hex key, can be used to tighten the set screws 260 and 262 such that the screws 260 and 262 bear against the neck 144 of the spindle 140. Similarly, the tool can be used to loosen the set screws 260 and 262 so that knob 250 can be rotated relative to spindle 140 about axis 130 to adjust a calibration or "zero" setting of the device 100, as described in further detail below. In other embodiments, knob 250 may be sized and dimensioned to snap fit or press fit over spindle 140.

An indicator 270 slips over a base of the knob 250 and is typically marked with a scale around its circumference that allows the user to take a reading with respect to an index mark on the seat 101. The indicator ring 270 preferably includes a notch 272 that mates with a boss 252 on the knob 250 so that the indicator ring 270 can be aligned with the knob 250. As a lock ring 280 is threaded onto the base of the knob 250, the indicator ring 270 is sandwiched between a shoulder 253 of the knob 250 and the lock ring 280. The indicator ring 270 may be replaced with another similar indicator ring, but bearing a different set of markings to customize an auto-locking dial for a particular device. For example, when an auto-locking dial is used to adjust a setting of a riflescope, such as elevation, an indicator ring 270 that is specific to the caliber of the rifle to which the riflescope is mounted may be included on the knob 250. Such a caliber-specific indicator ring 270 preferably includes markings appropriately spaced to compensate for bullet drop for the caliber at particular distances. With such an indicator ring 270 attached to knob 250, after a rifle is zeroed at a known distance a shooter merely turns the knob 250 to a different distance indicated by ring 270 to hit a target at that distance using the specific caliber of the rifle. In other embodiments, indication marks may be made directly on a knob, such as knob 250.

A set of actuator shafts 230 and 232 are inserted into a set of opposed bores 254 formed in the knob 250. The actuator shafts 230 and 232 include a threaded portion 233 that threads into a threaded bore 243 of buttons 240 and 242 (which are shown having a C-shape). In the illustrated embodiment, actuator shafts are inserted into cavity 256 of knob 250 such that shoulders 234 prevent actuator shafts 230 and 232 from passing completely through bores 254. Connecting actuator shafts 230 and 232 to buttons 240 and 242, respectively, help hold buttons 240 and 242 in place on knob 250. In other embodiments, actuator shafts, such as actuator shafts 230 and 232, may be formed as part of buttons, such as buttons 240 and 242. A set of biasing elements, such as springs 290 and 292, are optionally provided to bias the buttons 240 and 242 toward an extended position (as shown in FIG. 4). The springs 290 and 292 may be positioned in bores formed in the knob 250. In some embodiments, spring 210 acting via linkage 270 may impart sufficient force on actuator shafts 230 and 232 to bias the buttons 240 and 242 toward an extended position.

The actuator shafts 230 and 232 are provided with a sloped surface 231, which may include a frustoconical shaped portion that interacts with a sloped portion 171, such as a hemispherical shaped portion of the linkage 170. The sloped surface of actuator shafts 230 and 232 and the sloped portion of linkage 170 may include flat or relatively flat surfaces, curved surfaces, or other suitable shapes or contours. In other embodiments, sloped surfaces 231 and 171 are configured and arranged to pull linkage 170 upwardly away from surface 147 when buttons 240 and 242 move toward the axis 130. In one such embodiment a circumferential groove similar to circumferential groove 224 may be included in protrusion 176 such that the circumferential groove is located below actuator shafts 230 and 232. Circumferential groove 224 may be located underneath wedge pin 180 instead of over wedge pin 180 as illustrated in FIGS. 4 and 5. Thus, when actuator shafts 230 and 232 move toward each other, protrusion 176 moves upward as does locking pin 220.

Figure 10:
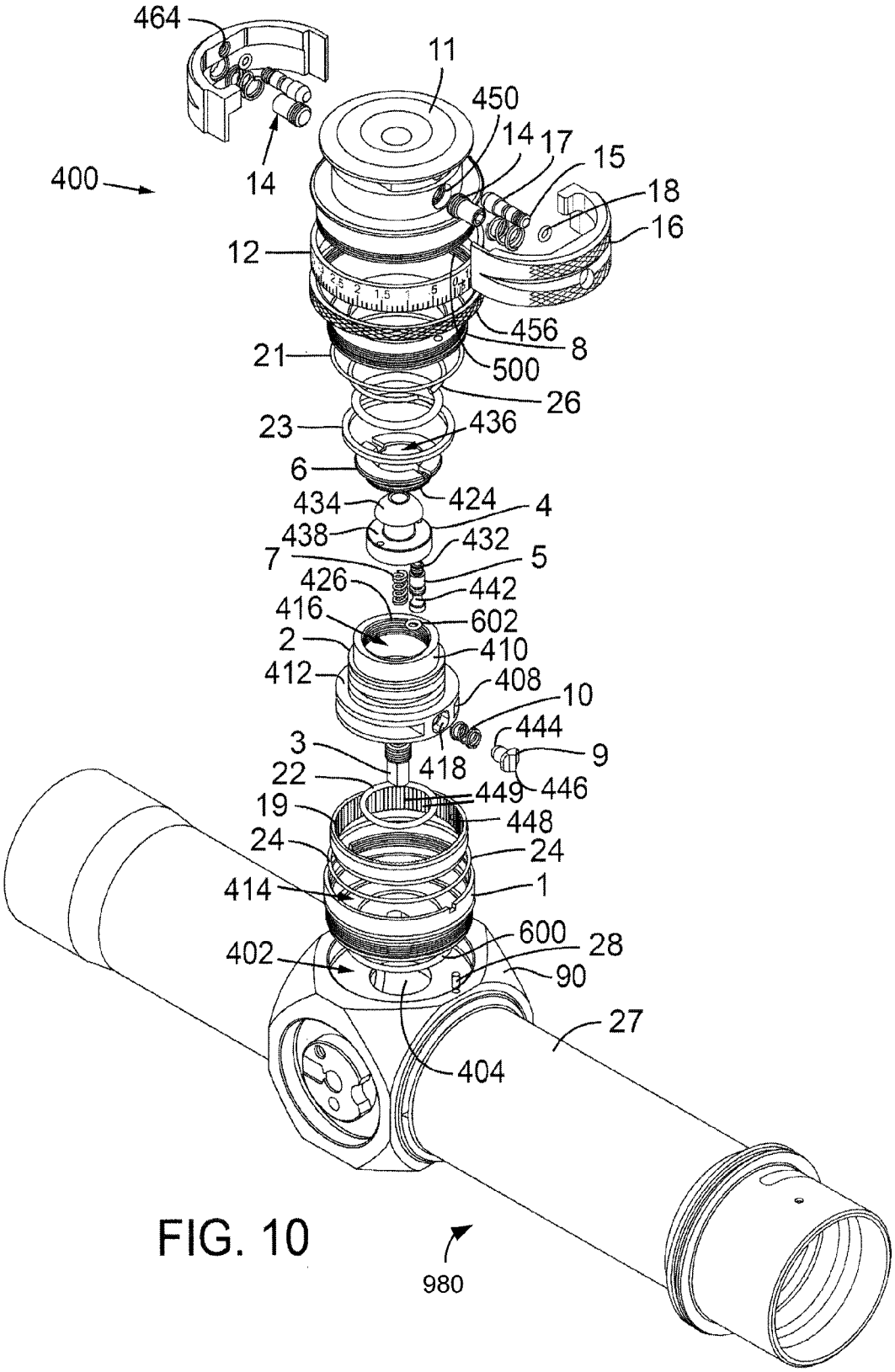
FIG. 10 is an exploded view of an auto-locking device, according to another embodiment.
Figure 11A:
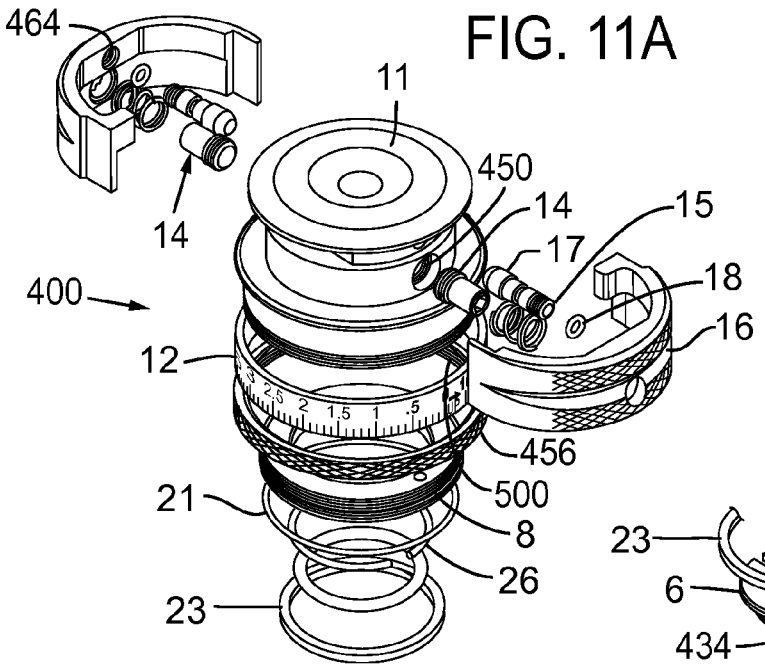
FIGS. 11A, 11B, and 11C are enlarged exploded views of the auto-locking device of FIG. 10.
Figure 11B:
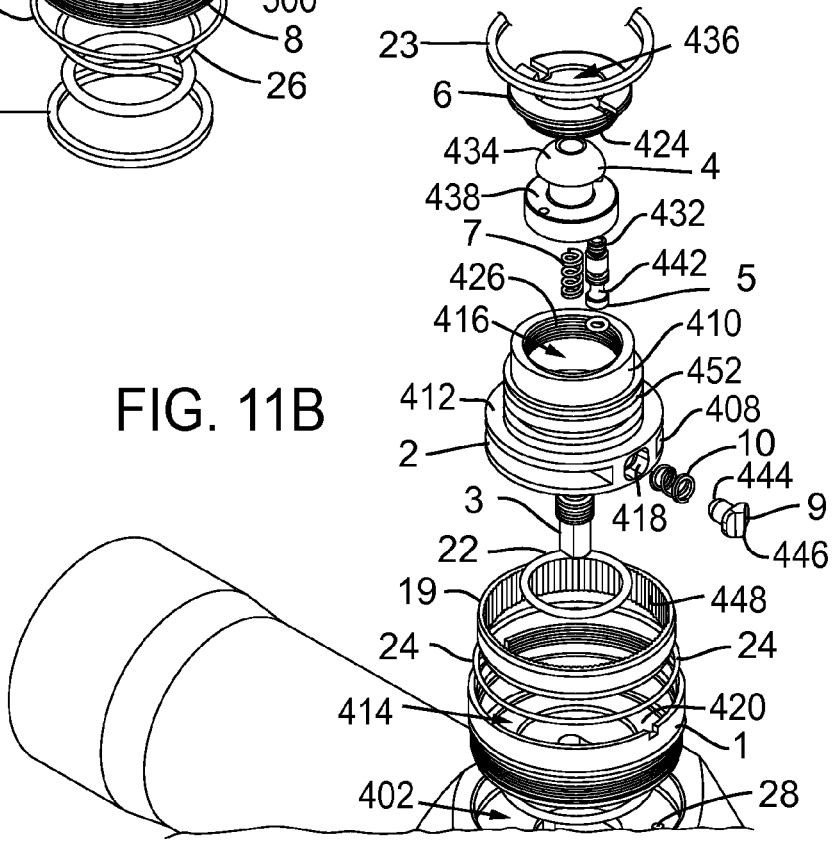
Figure 11C:
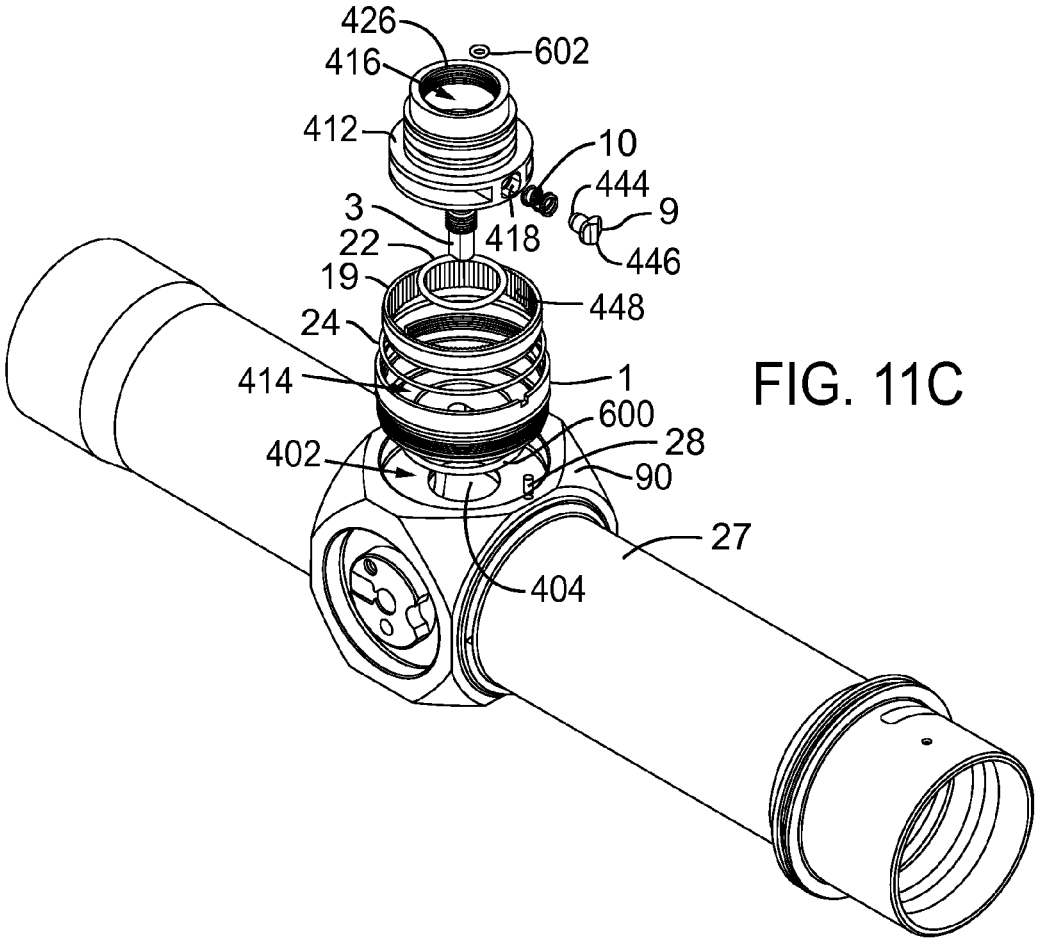
Figure 12:
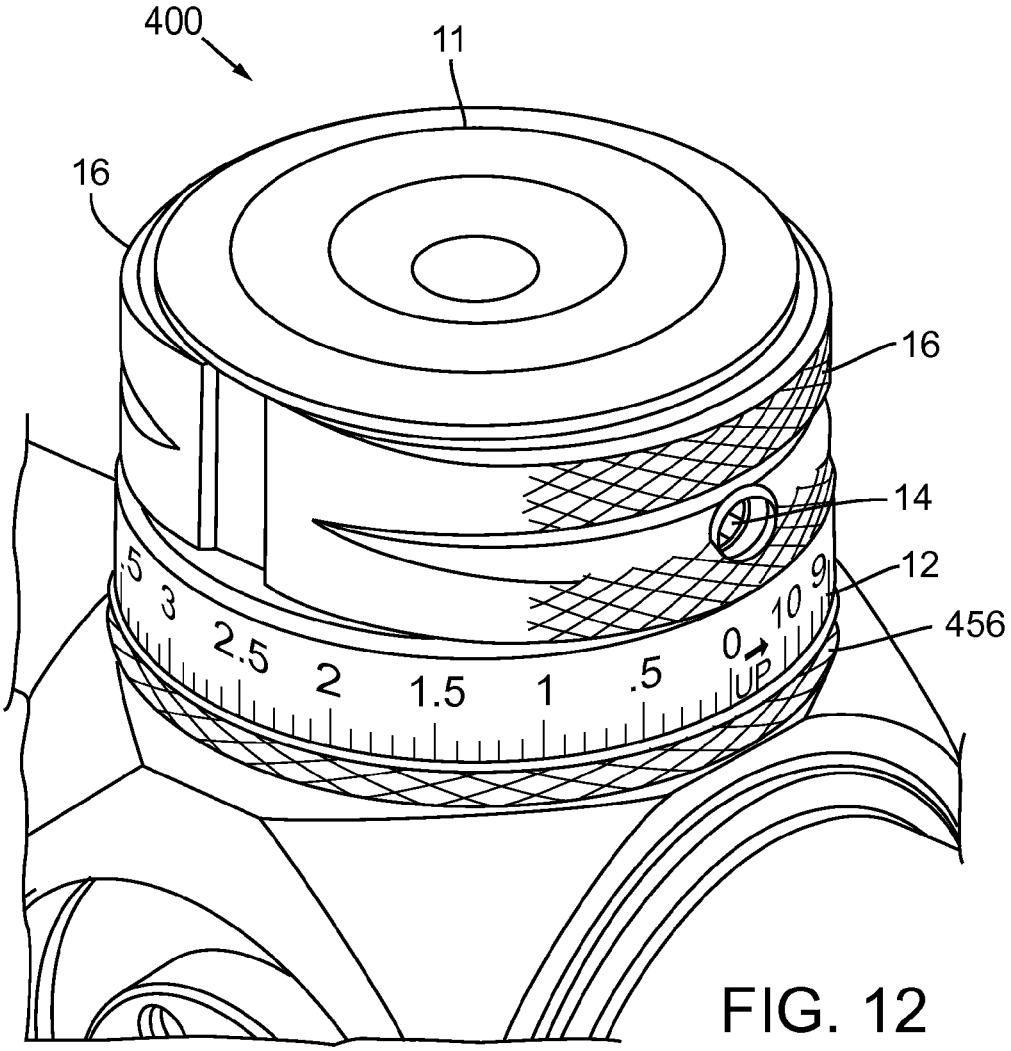
FIG. 12 is a perspective view of the auto-locking device of FIG. 10.
Figure 13:
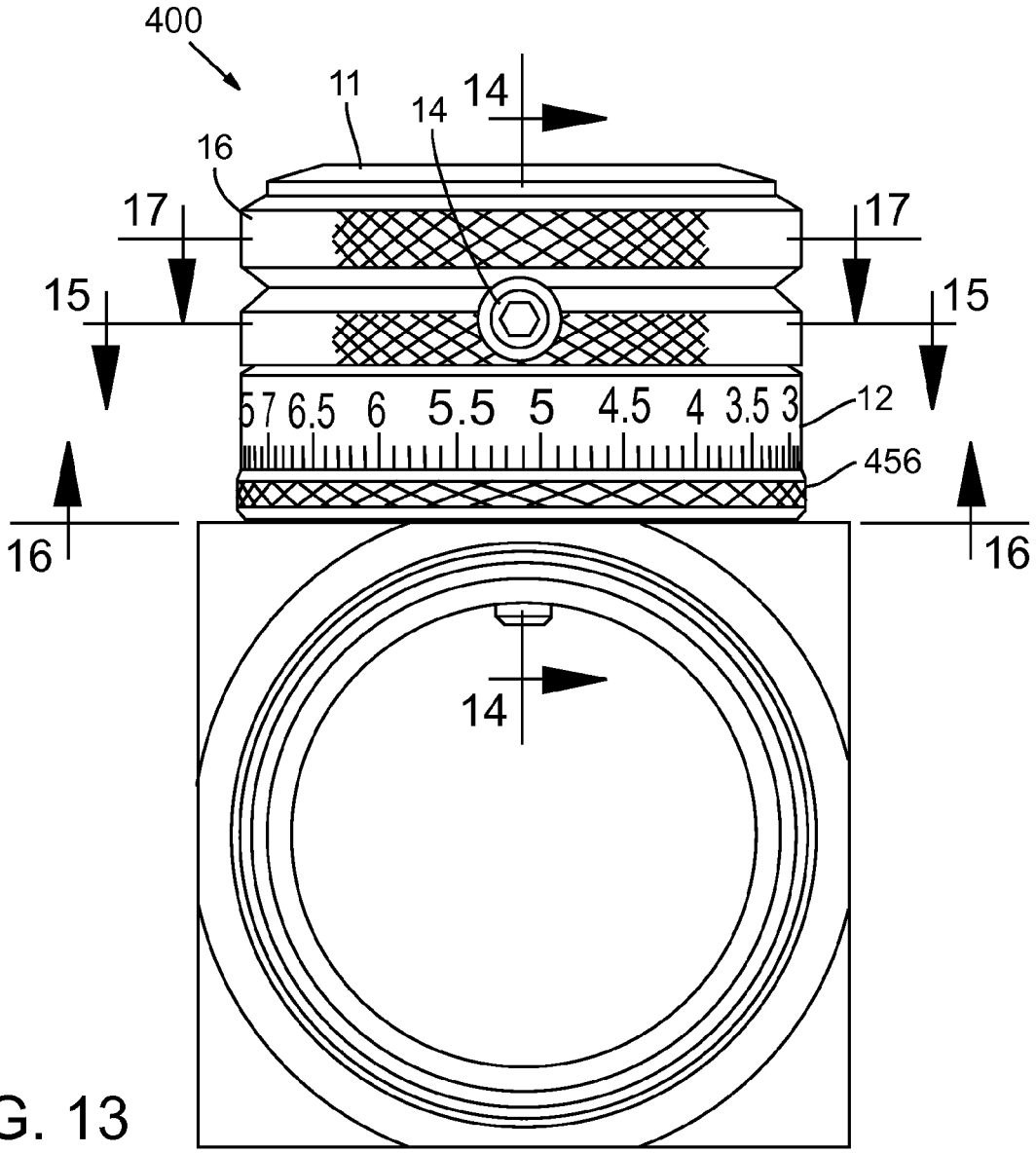
FIG. 13 is a side view of the auto-locking device of FIG. 10.
Figure 17:
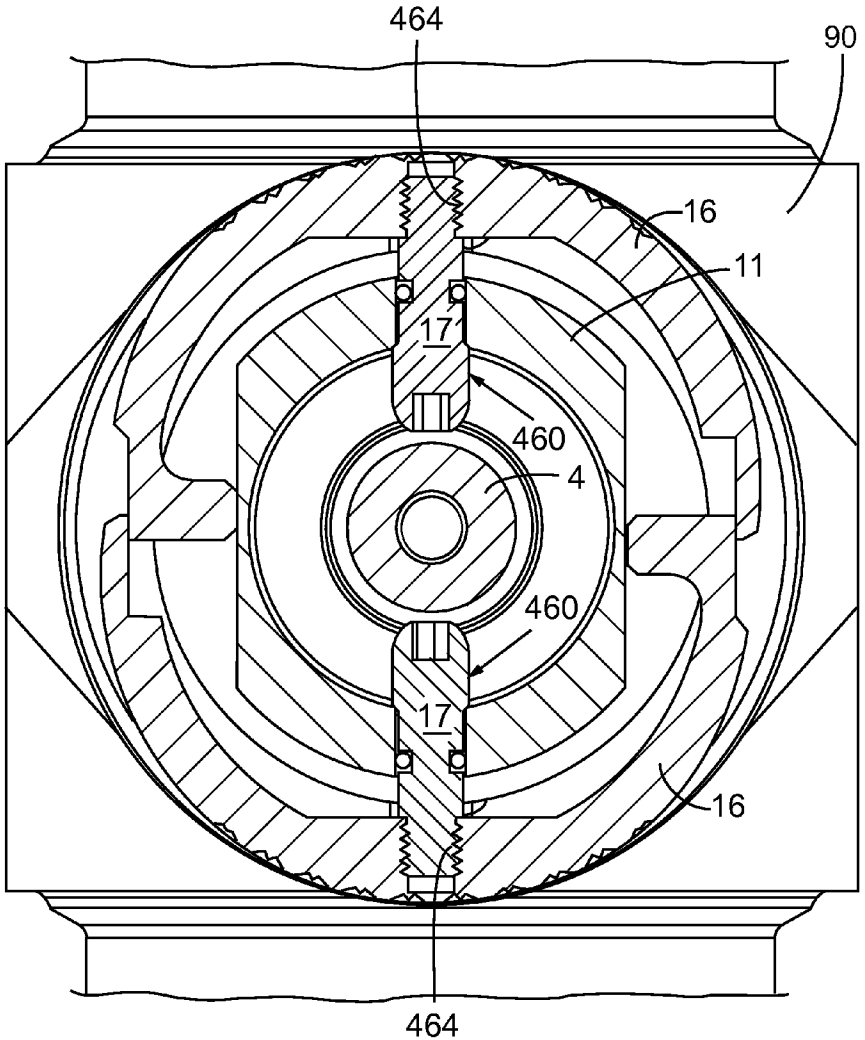
FIG. 17 is a cross-sectional view of the auto-locking device of FIG. 10 taken along line 17-17 of FIG. 13.

As shown in FIG. 2, the actuator shafts 230 and 232 may be offset from each other. In addition, the actuator shafts 230 and 232 may be in-line with each other (as shown in FIG. 17), which may help avoid play between the actuator shafts 230 and 232 and the linkage 170. The buttons 240 and 242 can be spaced apart (as shown in FIG. 2) or can slide over each other (as shown in FIG. 10). Alternatively, a single actuator may be used. In some embodiments, an actuator includes both a button, such as button 240, and an actuator shaft, such as actuator shaft 230. In other embodiments, an actuator includes an actuator shaft.

The operation of the auto-locking device 100 will now be described with reference to FIG. 4 (illustrating a locked configuration) and FIG. 5 (illustrating an unlocked configuration). The user actuates or unlocks the auto-locking device 100 by grasping and squeezing or radially pinching the buttons 240 and 242 between a thumb and finger. Such grasping and squeezing causes the actuator to move toward the axis 130, for example, actuator shafts 230 and 232 move toward the linkage 170 against the bias of the springs 290 and 292 as illustrated in FIG. 5. In one arrangement, when buttons 240 and 242 are squeezed, the linkage 170 moves to an unlocked position after an outer surface 244 of each button 240 and 242 moves toward the axis of rotation 130 such that the outer surface 244 is located substantially even with, or inward of, an outer surface 255A, 255B, or both of knob 250, for example, as illustrated in FIG. 5.

The sloped surfaces 231 of the actuator shafts 230 and 232 interact with the sloped portion 171 of the linkage 170 to cause the linkage 170 to move along with the locking pin 220 (which is coupled to the linkage 170) against the bias of spring 210 to an unlock position. In other words, the interaction between the actuator and the linkage 170 is configured to convert radial motion of the actuator shafts 230 and 232 into axial motion of the locking pin 220. After the linkage 170 has moved to an unlocked position, for example adjacent or abutting the bottom surface 147 of the cavity 145, the circumferential groove 224 of the locking pin 220 is aligned with the wedge pin 180. As previously noted, the wedge pin 180 is biased by the spring 186 to engage the engagement surface 192 of the lock ring 190. But, when the circumferential groove 224 is aligned with the wedge pin 180, the butt 182 of the wedge pin 180 can enter the circumferential groove 224 thus permitting wedge pin 180 to engage and disengage the engagement surface 192 of the lock ring 190 as the user rotates the knob 250 the spindle 140, and wedge pin 180 about the axis 130. Rotation of the spindle 140 causes the plunger 120 to move along the axis 130 thereby adjusting a position of an adjustable portion of a device, such as the inner tube 103, for example. In other arrangements, an engagement member, such as wedge pin 180, may be coupled to a link, such as linkage 170 and locking pin 220, for movement along axis 130. Accordingly, an engagement surface is preferably positioned and configured to interferingly interact with the engagement member when the link is in a lock position and to facilitate rotation of a rotatable portion when the link is in an unlock position.

When the user releases the buttons 240 and 242, the springs 290 and 292 cause the buttons 240 and 242 and the actuator shafts 230 and 232 to move to the position illustrated in FIG. 4. Once the actuator shafts 230 and 232 are out of the way, the spring 210 causes the linkage 170 and the locking pin 220 to move upward toward the position shown in FIG. 4. In other embodiments, the spring 210 is sufficiently strong to move the linkage 170 and the buttons 240 and 242 to the positions shown in FIG. 4 without springs 290 and 292. Because the circumferential groove 224 is no longer aligned with the wedge pin 180, the locking pin 220 causes the wedge shaped portion 184 of the wedge pin 180 to engage at least one of the regularly spaced apart features of the engagement surface 192 of the lock ring 190. Because the lock ring 190 is anchored to the main tube 102, the wedge pin 180 (which is coupled to the spindle 140 for rotation therewith) prevents the spindle 140, and thus the knob 250, from rotating about the axis 130 (i.e., the knob 250 is automatically locked once an external force is removed from the actuator, such as buttons 240 and 242 and actuator shafts 230 and 232).

Any number of optional seals, such as O-rings, may be provided to keep out contamination. For example, as illustrated in FIG. 3 an O-ring 300 may be provided between the seat 101 and the spindle base 110, an O-ring 302 may be provided between the spindle base 110 and the knob 250, an O-ring 304 may be provided between the spindle 140 and the spindle base 110, an O-ring 306 may be provided between the spindle 140 and the flanged retaining nut 150, and an O-ring 308 may be provided between the spindle retaining nut 200 and the spindle 140. In addition, O-rings 310 may be provided between the actuator shafts 230 and 232 and the knob 250. Optionally, thread lock materials or waterproofing materials, such as LocTite® or Teflon® tape may be included at any or all of the threaded interfaces (but not between the plunger 120 and spindle 140).

In some embodiments, a knob, such as knob 250, or a spindle, such as spindle 240, may not be needed. Other embodiments include both a spindle and a knob, for example, the embodiment illustrated in FIG. 4A includes a spindle 140A that houses a link 170A that includes a locking pin portion 220A. Depending on the location and orientation of a sloped portion 171A of link 170A, one or more actuators, such as button 240A and actuator shaft 230A may be included. Assembly and operation of the embodiment illustrated in FIG. 4A is substantially similar to that described above with reference to FIGS. 4 and 5.

With reference to the embodiment illustrated in FIGS. 1-5, a marksman may calibrate the auto-locking device 100 (i.e., reorient the indicator ring 270 relative to the spindle 140) by loosening the set screws 260 and 262, which allows the knob 250 and indicator ring 270 to rotate relative to the spindle 140. After completing the calibration, the set screws 260 and 262 are again tightened to rotationally couple the knob 250 to the spindle 240.

FIGS. 6-9 illustrate an embodiment including a rotation limiting mechanism comprising an adjustment stop 320. The adjustment stop 320 includes a handle or knob 322 and a cam surface 324. By rotating the handle 322, the cam surface 324 urges a pin 326 in and out of a bore formed in the seat 101. In other embodiments, the bore may be formed in the device itself. When the pin 326 is in an extended position (FIG. 8), a protrusion, such as finger 328, (which may protrude from the knob 250) interferes with the pin 326 and prevents the knob 250 from making more than one complete rotation about the axis 130. When the pin 326 is in a retracted position (FIG. 9), the finger 328 clears the pin 326 and allows the knob 250 to make more than one complete rotation about the axis 130. For example, the auto-locking device 100 may be capable of making three full revolutions, but the user may limit the travel of the knob 250 to just one revolution by extending or retracting the pin 326.

FIGS. 10-21 illustrate various views of an auto-locking device 400 according to another embodiment having a different arrangement of actuator shafts and a different rotation limiting mechanism. As shown in FIG. 10, the auto-locking device 400 is mounted to an optical device 980, specifically to a main tube 27 of a riflescope. Within the main tube 27 of the riflescope, an inner tube bearing a reticle or lens assembly may be movably mounted perpendicular to a longitudinal tube axis, for example, by a ball-and-socket joint between one end of the inner tube and the main tube 27. The seat 90 includes a bore 402 sized to receive the auto-locking device 400. The bore 402 preferably includes threads formed on an interior wall or shoulder of the bore 402 that mate with threads on a spindle base 1. An aperture 404 is formed at the base of the bore 402 and is sized to receive a threaded plunger or screw 3. The plunger 3 acts on the inner tube and is constrained from rotating about an axis of rotation 406 (FIG. 14A) so that rotation of a spindle 2 (into which the plunger 3 is threaded) is translated into linear motion of the plunger 3 along the axis 406, thereby adjusting a position of the reticle or lens assembly (e.g., the reticle is shifted perpendicular to the tube axis). One or more of the main tube 27, the inner tube, the optics, or the reticle may take other configurations, for example, those described above with reference to FIGS. 1-5.

Referring now to FIGS. 10-17, the plunger 3 is coupled to the inner tube. For example, a rectangular hole in the inner tube may be aligned with the center of the aperture 404 and the rectangular hole may be sized to receive a keyed end of the plunger 3 to prevent the adjustment plunger 3 from rotating about the axis of rotation 406 (FIG. 14A). The plunger 3 may be coupled to the inner tube in other ways, such as threaded into the inner tube, welded to the inner tube, or otherwise secured to the inner tube (e.g., via an epoxy). The plunger 3 includes threads at an end of the plunger 3 opposite the keyed end. The threads are preferably sized to mesh with interior threads of the spindle 2 so that the plunger 3 can be threaded into the spindle 2. Thus, rotation of the spindle 2 about the axis of rotation 406 is translated into linear motion of the plunger 3 along the axis of rotation 406, thereby adjusting a position of the inner tube (and thus the reticle or optics therein).

The spindle 2 includes a lower base portion 408 and an upper neck portion 410, and is similar to the spindle described above, including being sandwiched between a flanged lock nut 8 and the spindle base 1. Spindle 2 is rotatable about the axis of rotation 406 but is constrained from traveling along the axis of rotation 406 by the flanged lock nut 8 and the spindle base 1. A washer 23, similar to washer 160 described above, may optionally be included to facilitate rotation of the spindle 2 within a cavity 414 of the spindle base 1. The upper neck portion 410 of the spindle 2 extends through a central aperture of the flanged lock nut 8 and includes a cavity 416 into which a contact or linkage 4 nests. The spindle 2 also includes a bore 418 into which a clicker or wedge pin 9 extends. Additional details of the linkage 4 and the wedge pin 9 will be described in more detail below.

The spindle base 1 is threaded onto the seat 90 so that the spindle base 1 does not rotate relative to the seat 90 as the spindle 2 rotates about the axis of rotation 406. A click or lock ring 19 is interposed between a shoulder 420 of the spindle base 1 and the flanged lock nut 8 and is preferably constrained from rotating about the axis of rotation 406. For example, as the outer threads on the flanged lock nut 8 are threaded into the interior threads of the spindle base 1, the lock ring 19 is pinched between the shoulder 420 of the spindle base 1 and the flanged lock nut 8 to thereby prevent the lock ring 19 from rotating about the axis 406. The lock ring 19 may be prevented from rotating about the axis 406 in other ways, such as being secured to the spindle base 1 (e.g., via a weld or epoxy). In addition, a pin may extend between the spindle base 1 and the lock ring 19 to prevent rotation relative to each other. Thus, the spindle base 1, the lock ring 19, and the flanged lock nut 8 are anchored to the seat 90 and are prevented from rotating about the axis 406 when the auto-locking device 400 is in a locked or unlocked position.

A locking mechanism includes a linkage 4 nested in the cavity 416 of the spindle 2 between a bottom surface 422 of the cavity 416 and a spindle retaining nut 6. The retaining nut 6 is provided with outer threads 424 that mate with inner threads 426 of the neck 410 of the spindle 2. The retaining nut 6 limits the travel of the linkage 4 along the axis 406. The linkage 4 includes a bore 426 sized to receive a spring 7, which is provided to bias the linkage 4 toward a locked position, for example, away from the bottom surface 422 of the cavity 416. The linkage 4 also includes an offset bore 430, which includes interior threads sized to mate with a threaded portion 432 of a locking pin 5. Locking pin 5 is assembled with linkage 4 to form a link. Other suitable links, such as those describe above, may be used. A protrusion 434 of the linkage 4 extends through an aperture 436 of the retaining nut 6 for interaction with a pair of actuator shafts 17. Thus, the linkage 4 is configured for movement between a first (locked) position (FIGS. 14A, 18, and 20) and a second (unlocked) position (FIGS. 19 and 21). The locking pin 5 travels along with the linkage 4 as the link moves between the first and second positions along the axis 406.

Figure 14A:
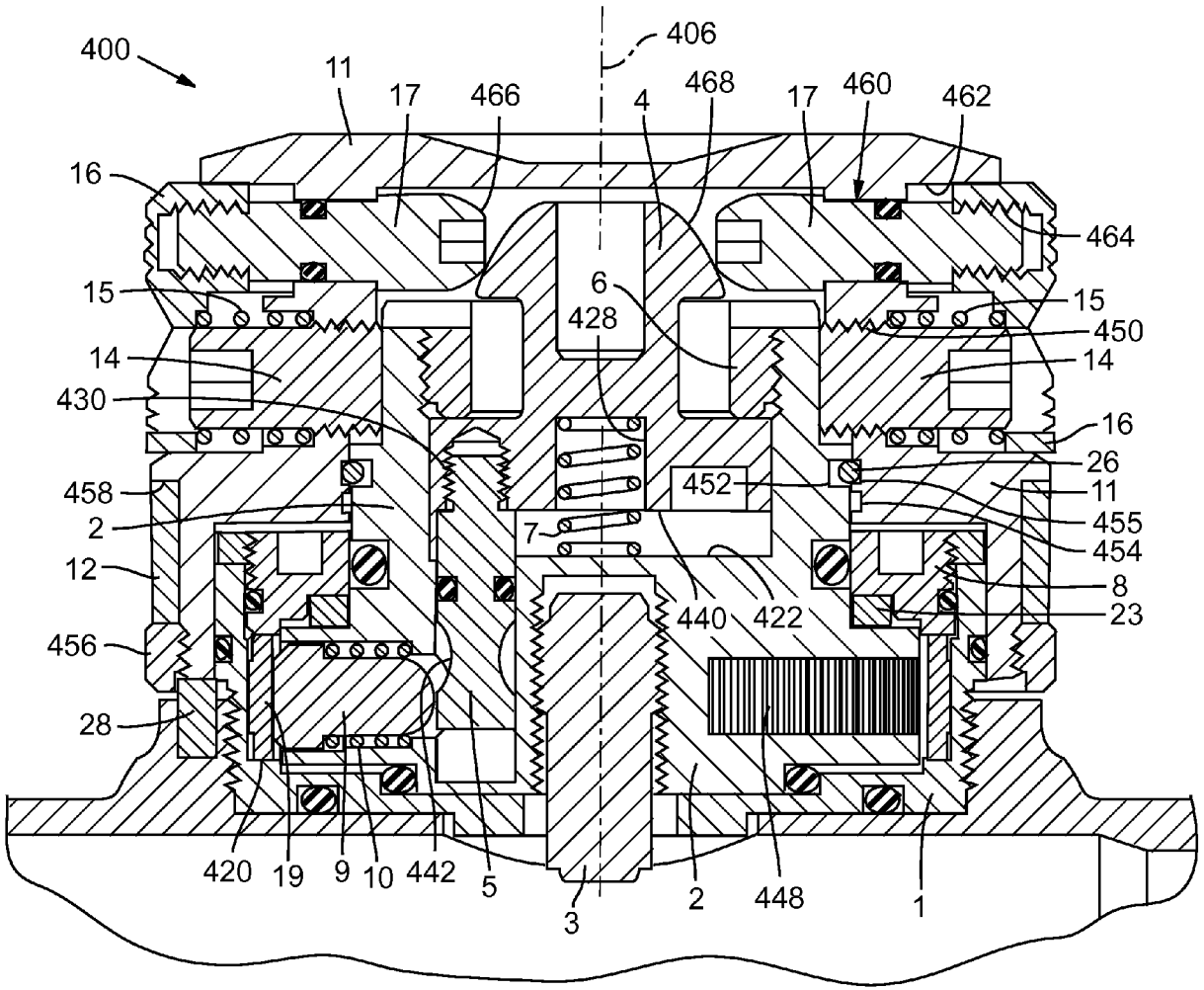
FIGS. 14A and 14B are cross-sectional views of the auto-locking device of FIG. 10 taken along line 14-14 of FIG. 13 illustrating the auto-locking device in a locked position.
Figure 14B:
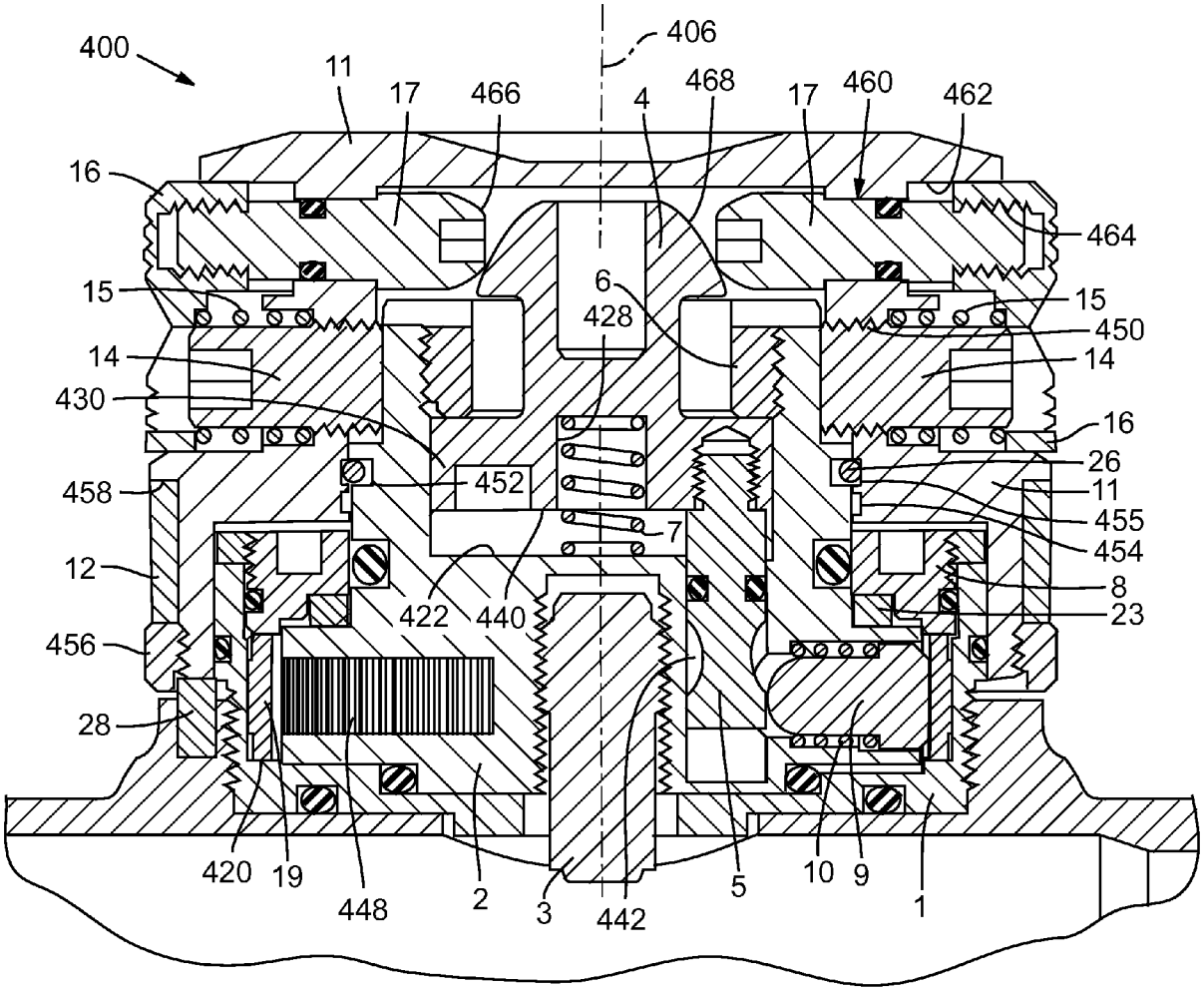

The locking pin 5 includes a circumferential groove 442 into which a butt 444 of the wedge pin 9 can enter, for example, as described above. When the locking pin 5 is positioned as shown in FIG. 14A, the locking pin 5 urges a wedge portion 446 of the wedge pin 9 to engage an engagement surface 448 of the lock ring 19. When the locking pin 5 is positioned as shown in FIGS. 19 and 21, the circumferential groove 442 is aligned with the wedge pin 9. As the spindle 2 rotates about the axis of rotation 406, the wedge portion 446 of the wedge pin 9 is permitted to disengage the regularly spaced apart features of the engagement surface 448 because the butt 444 of the wedge pin 9 can enter the circumferential groove 442 against the bias of spring 10. According to one embodiment, the spring 10 biases the wedge pin 9 toward the lock ring 19. The wedge pin 9 may provide tactile feedback to the user when lock ring 19 also serves as a click ring by including optional regularly spaced apart features on or in the engagement surface 448 and the wedge pin 9 engages and disengages such regularly spaced apart features 449. When an optional click ring is included, or lock ring 19 is also configured as a click ring, a user can determine an angular rotation of the spindle 2 by counting the number of clicks.

A knob 11 is installed over the spindle 2 and the spindle base 1. The knob 11 includes a set of opposed threaded bores 450 sized to receive a pair of threaded set screws 14. Any number of set screws may be provided around the axis 406. As illustrated in FIG. 14A, the set screws 14 rotationally couple the knob 11 to the neck 410 of the spindle 2. A tool, such as a hex key, can be used to tighten the set screws 14 such that the screws 14 bear against the neck 410 of the spindle 2. Similarly, the tool can be used to loosen the set screws 14 so rotation of the knob 11 does not cause the spindle 2 to rotate about the axis 406.

A circumferential groove 452 is formed in spindle 2 and is sized to accommodate a snap ring 26. The snap ring 26 is compressed when inserted into the circumferential groove 452 so that the snap ring 26 will expand into a circumferential groove 454 or 455 formed in the knob 11 when either circumferential groove 454 or 455 is aligned with the circumferential groove 452 (which will be described in more detail with reference to FIGS. 18-21 below).

An indicator 12 slips over a base of the knob 11 and is typically marked with a scale around its circumference that allows the user to take a reading with respect to an index mark on the main tube 27. The indicator 12 may be provided with a notch that mates with a boss on the knob 11 so that the indicator 12 can be aligned with the knob 11, for example, as described above with reference to FIGS. 1-5. As a lock ring 456 is threaded onto the base of the knob 11, the indicator 12 is sandwiched between a shoulder 458 of the knob 11 and the lock ring 456.

A set of actuator shafts 17 are inserted into a set of opposed bores 460 formed in the knob 11. The actuator shafts 17 include a threaded portion 462 that threads into a threaded bore 464 of buttons 16 (which are shown having a C-shape). A set of springs 15 are provided to bias the buttons 16 toward an extended position (as shown in FIG. 14A). The actuator shafts 17 are provided with a curved or sloped portion 466 that interacts with a curved or sloped portion 468 of the linkage 4. Other suitable shapes or contours may be provided, such as those described with reference to FIGS. 1-5. Alternatively, a single actuator may be used.

Figure 15:
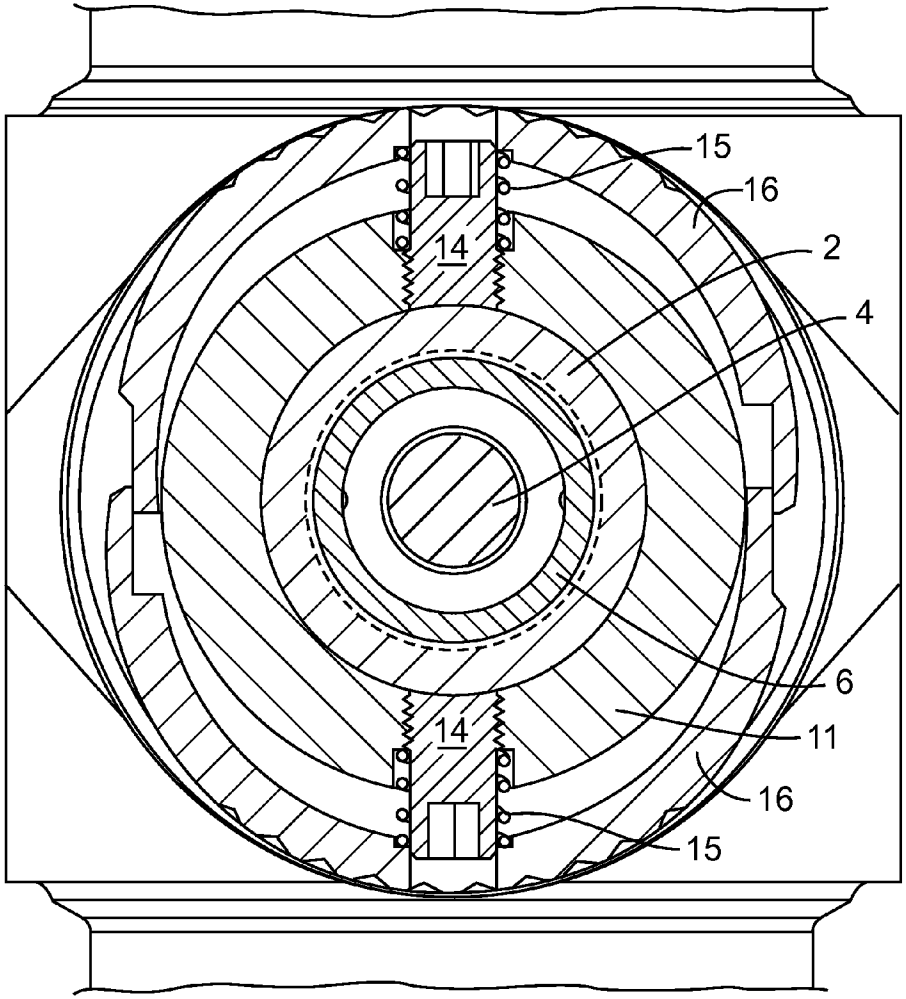
FIG. 15 is a cross-sectional view of the auto-locking device of FIG. 10 taken along line 15-15 of FIG. 13.
Figure 16:
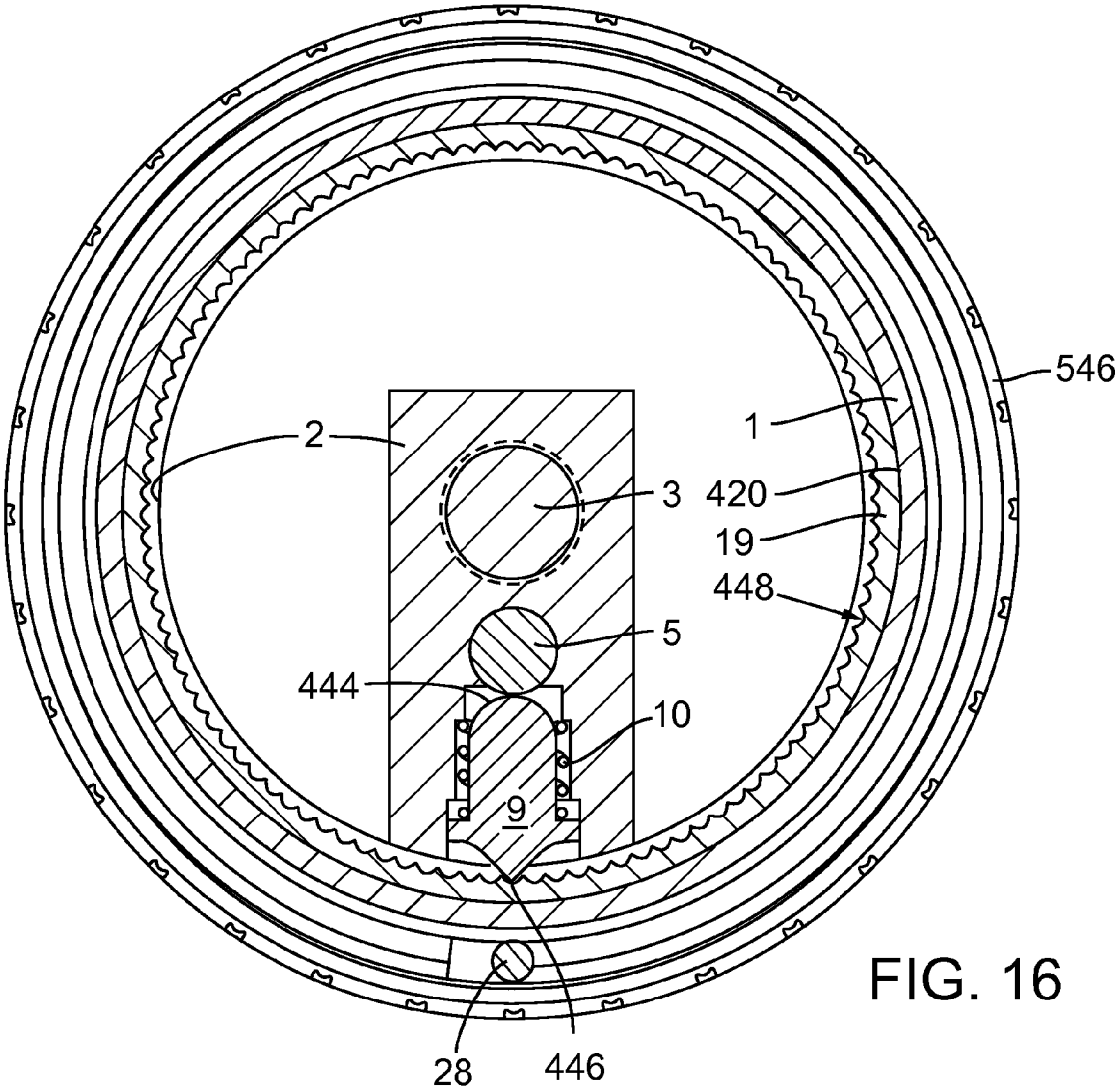
FIG. 16 is a cross-sectional view of the auto-locking device of FIG. 10 taken along line 16-16 of FIG. 13.

As shown in FIG. 17, the actuator shafts may be in-line with each other, which may help avoid play between the actuator shafts 17 and the linkage 4. In addition, the actuator shafts 17 may be offset from each other as described with reference to FIGS. 1-5. The buttons 16 can slide over each other (as shown in FIGS. 10, 15, and 16) or the buttons 16 can be spaced apart (as shown in FIGS. 1-5). Alternatively, a single actuator may be used.

The operation of the auto-locking device 400 will now be described with reference to FIGS. 14A, 18, and 20 (illustrating a locked configuration) and FIGS. 19 and 21 (illustrating an unlocked configuration). The user actuates or unlocks the auto-locking device 400 by grasping and squeezing or radially pinching the buttons 16 which causes the actuator shafts 17 to move toward the linkage 4 against the bias of the springs 15. The curved portion 466 of the actuator shafts 17 interact with the curved portion 468 of the linkage 4 to cause the linkage 4 to move with the locking pin 5 (which is coupled to the linkage 4) against the bias of spring 7. In other words, the linkage 4 is configured to convert radial motion of the actuator shafts 17 into axial motion of the locking pin 5. Other suitable curved or sloped portions may be included on the actuator shafts 17 or on the linkage 4. After the linkage 4 has moved to a locked position, for example, adjacent or abutting the bottom surface 422 of the cavity 416, the circumferential groove 442 of the locking pin 5 is aligned with the wedge pin 9. As previously noted, the wedge pin 9 may be biased by the spring 10 to engage (or disengage) the engagement surface 448 of the lock ring 19. As the user rotates the knob 11, the spindle 2 rotates about the axis 406 along with the wedge pin 9. When the circumferential groove 442 is aligned with the wedge pin 9, the butt 444 of the wedge pin 9 can enter the circumferential groove 442 to permit spindle 2 to rotate and wedge pin 9 to engage and disengage the regularly spaced apart features formed in or on the engagement surface 448. Rotation of the spindle 2 causes the plunger 3 to move along the axis 406 (thereby adjusting a position of the inner tube).

Figure 18:
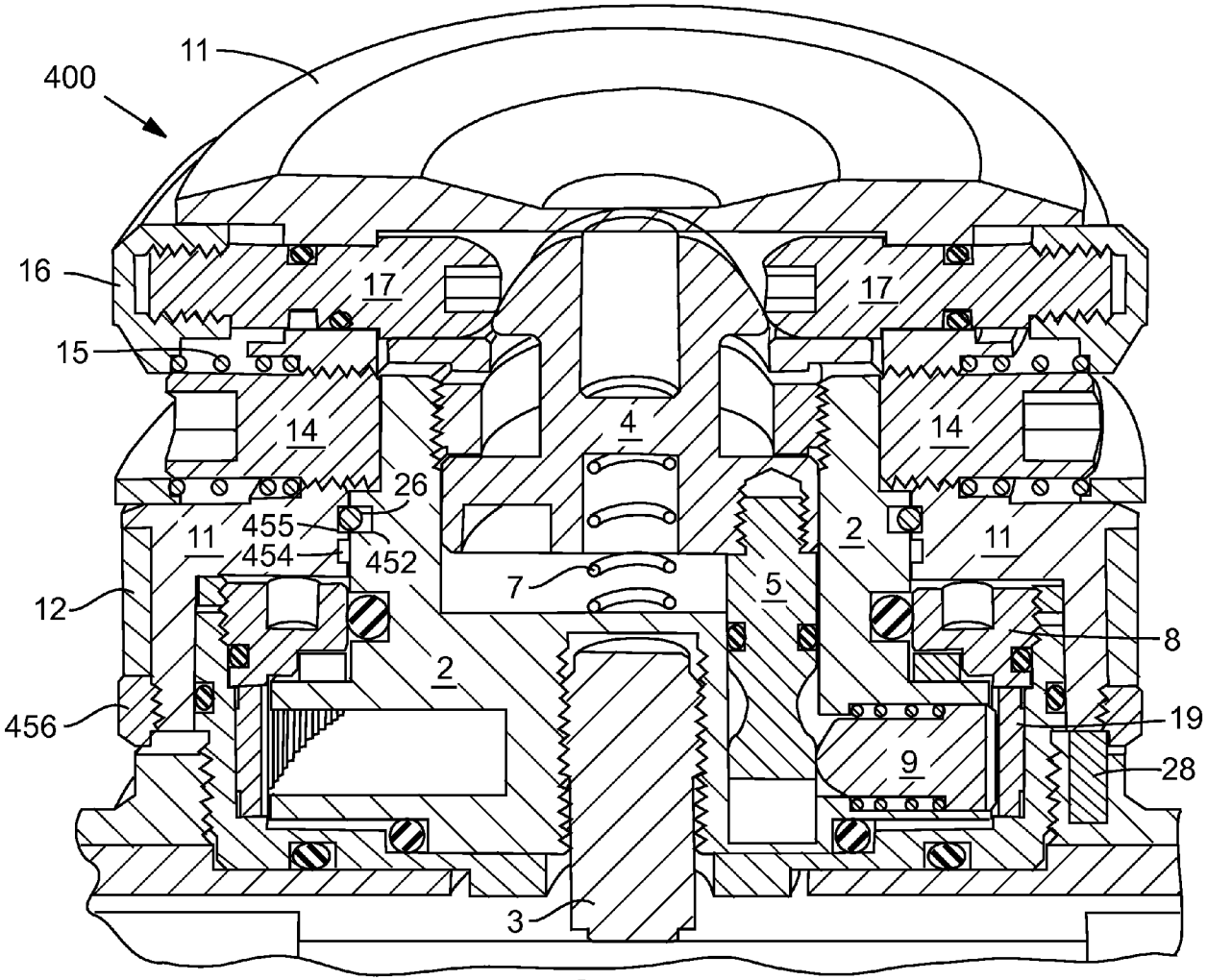
FIG. 18 is a cross-sectional view of the auto-locking device of FIG. 10 taken along line 14-14 of FIG. 13 illustrating the auto-locking device in a locked position and adjustment stop in an engaged position.
Figure 19:
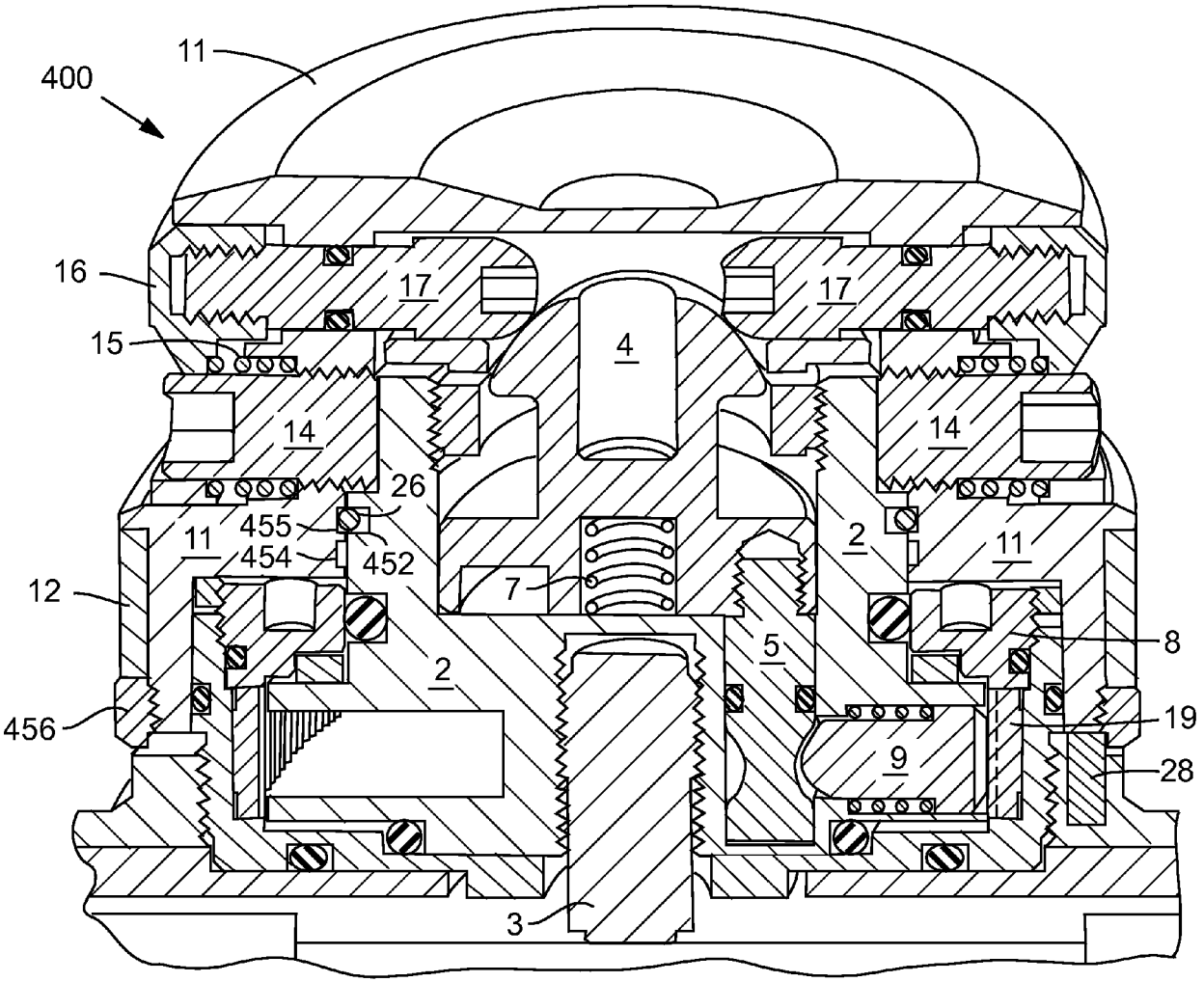
FIG. 19 is a cross-sectional view of the auto-locking device of FIG. 10 taken along line 14-14 of FIG. 13 illustrating the auto-locking device in an unlocked position and adjustment stop in an engaged position.
Figure 20:
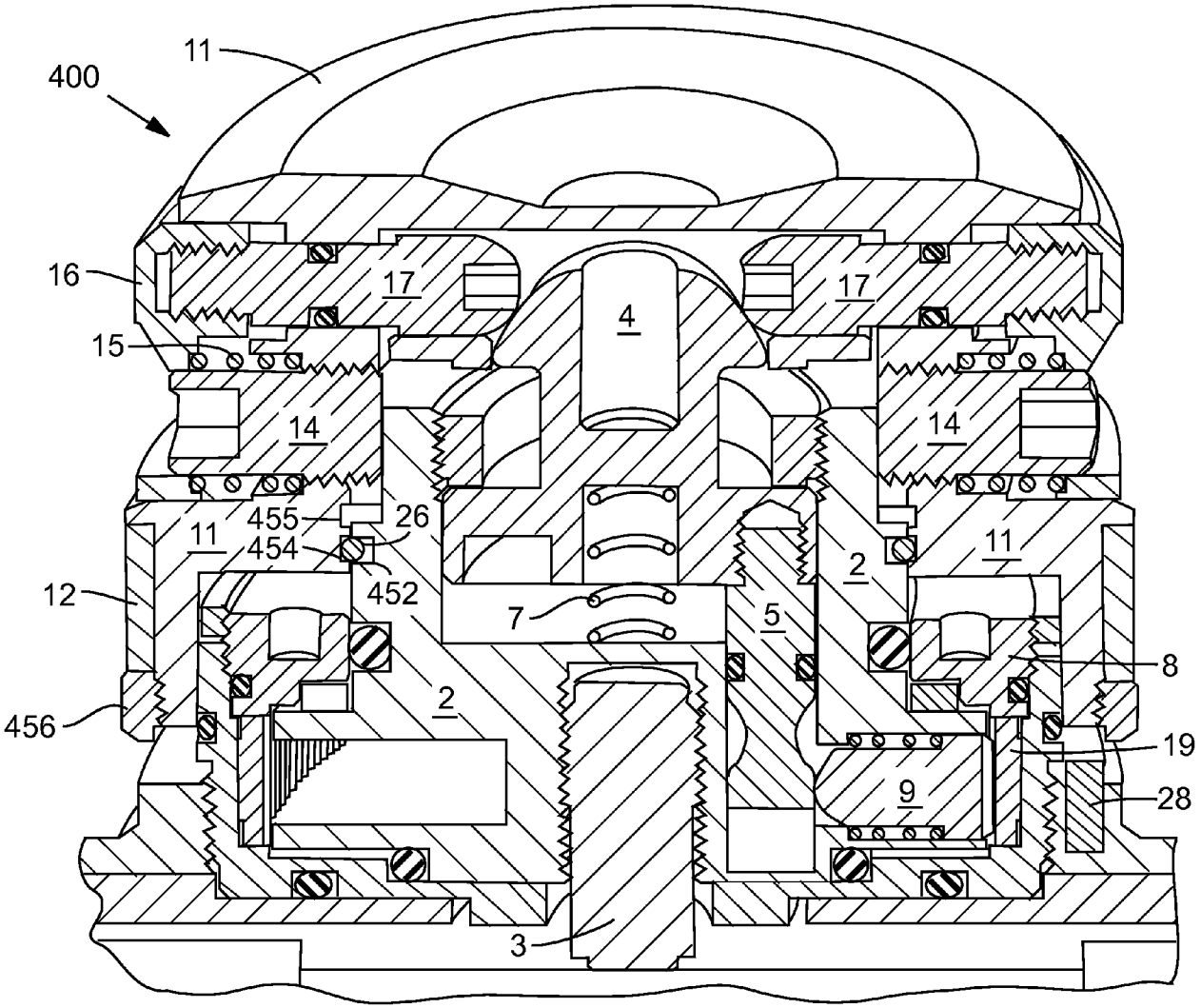
FIG. 20 is a cross-sectional view of the auto-locking device of FIG. 10 taken along line 14-14 of FIG. 13 illustrating the auto-locking device in a locked position and adjustment stop in a disengaged position.
Figure 21:
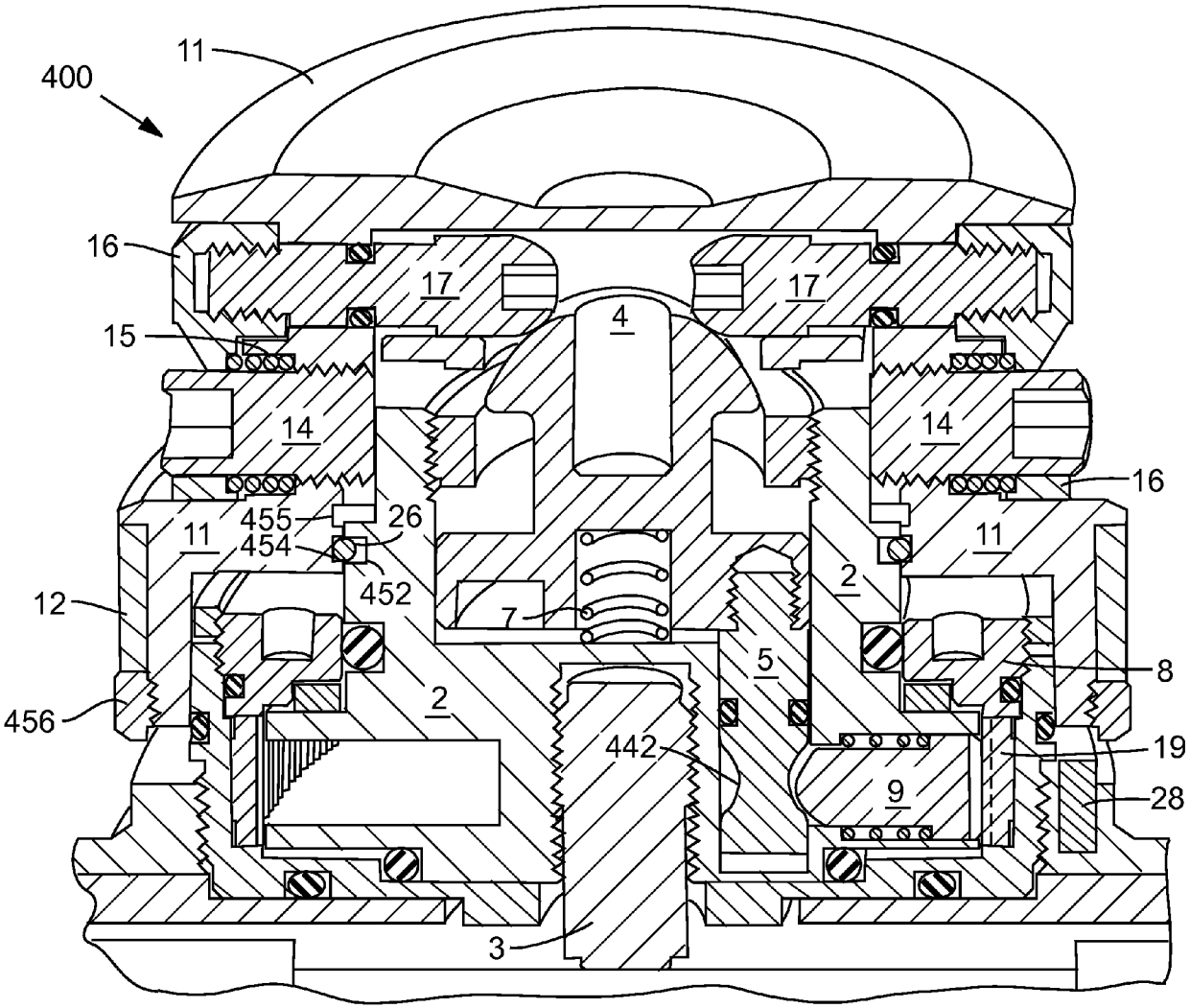
FIG. 21 is a cross-sectional view of the auto-locking device of FIG. 10 taken along line 14-14 of FIG. 13 illustrating the auto-locking device in an unlocked position and adjustment stop in a disengaged position.

When the user releases the buttons 16, the springs 15 cause the buttons 16 and the actuator shafts 17 to move to the position illustrated in FIGS. 14A, 18, and 20. Once the actuator shafts 17 are out of the way, the spring 7 causes the linkage 4 and the locking pin 5 to move upward toward the position shown in FIGS. 14A, 18, and 20. In other embodiments, springs 15 are not included because the spring 7 is sufficiently strong to cause linkage 4 and buttons 16 to move to the locked position. Because the circumferential groove 442 is no longer aligned with the wedge pin 9, the locking pin 5 causes the wedge shaped portion 446 of the wedge pin 9 to engage at least one of the regularly spaced apart features 449 of the lock ring 19. Because the lock ring 19 is anchored to the main tube 27, the wedge pin 9 (which is coupled to the spindle 2) prevents the knob 11 from rotating about the axis 406 (i.e., the knob 11 is automatically locked when an external force on the buttons 16 is removed).

FIGS. 18-21 also illustrate how the knob 11 can be adjusted between a first position in which the knob 11 is permitted one revolution of rotational travel (FIGS. 18 and 19) and a second position in which the knob 11 is permitted multiple revolutions of rotational travel (FIGS. 20 and 21). To move the knob 11 from the first position to the second position, the user loosens the set screws 14 and pulls the knob 11 up then retightens set screws 14. Conversely, to move the knob 11 from the second position to the first position, the user loosens the set screws 14 and pushes the knob 11 down. The user can pull the knob 11 up to remove the snap ring 26 from the circumferential groove 455 by compressing the snap ring 26 into circumferential groove 452 (of the spindle 2). The user continues to pull up until the circumferential groove 452 is aligned with the circumferential groove 454 (of the knob 11). After the circumferential grooves 452 and 454 are aligned, the snap ring 26 enters (e.g., expands and snaps into) the circumferential groove 454, thus letting the user know to stop pulling up (if the user keeps pulling up, the user can remove the knob 11). In other words, when the circumferential grooves 452 and 454 are aligned and the snap ring 26 snaps into the circumferential groove 454, a finger 500 (FIGS. 10 and 11A) or other protrusion of the knob 11 will clear a pin 28 (which is inserted into a bore of the seat 90 or of the device), which allows the knob 11 to make more than one complete rotation about the axis 406. For example, the auto-locking device 400 may be capable of making three full revolutions, but the user may selectively limit the travel of the knob 11 to just one revolution by positioning the knob 11 in the first position (where the snap ring 26 expands and snaps into circumferential groove 455 as illustrated in FIGS. 18 and 19). After the user pulls the knob 11 upwards to the second position (or conversely pushes the knob 11 downwards toward the first position), the user tightens the set screws 14 (thereby coupling the knob 11 to the spindle 2 for rotation therewith). Inclusion of snap ring 26 and circumferential grooves 452, 454, and 455 is optional, for example circumferential groove 454 may be omitted, circumferential groove 455 may be omitted, and all of snap ring 26 and circumferential grooves 452, 454, and 455 may be omitted in different embodiments. A user may visually inspect the clearance between a protrusion of the knob 11, such as finger 500, and a non-rotating portion, such as pin 28 in embodiments where circumferential groove 454 is omitted, circumferential groove 455 is omitted, or all of snap ring 26 and circumferential grooves 452, 454, and 455 are omitted.

A marksman may calibrate the auto-locking device 400 (i.e., reorient the indicator 12 relative to the spindle 2) by loosening the set screws 14, which allows the knob 11 and indicator 12 to rotate relative to the spindle 2. After completing the calibration, the set screws 14 are again tightened to rotationally couple the knob 11 to the spindle 2.

As described with reference to FIGS. 1-5, any number of optional seals, such as O-rings 18, 21, 22, 24, 600 and 602 (FIG. 10), may be provided to keep out contamination. Optionally, thread lock materials or waterproofing materials, such as LocTite® or Teflon® tape may be included at any or all of the threaded interfaces (but not between the plunger 3 and spindle 2). Any of the foregoing components may be made of metal, plastic, or another suitable material.

In addition to the variations and combinations previously presented, other arrangements and features are disclosed in U.S. Patent Publication No 2009/0205461 which is hereby incorporated by reference in its entirety.

In one example, a dial comprises a selectively lockable mechanism including, (A) a linkage coupled to the spindle for rotation therewith such that the linkage is moveable along the axis of rotation between the locked position and the unlocked position, wherein the linkage includes a first sloped surface, (B) a locking pin extending from the linkage, (C) a wedge pin slidably mounted in the spindle, and (D) a lock ring supported by the device such that the lock ring is not rotatable about the axis of rotation. The locking pin is configured to inhibit the wedge pin from moving away from the lock ring when the linkage is in the locked position and to facilitate movement of the wedge pin away from the lock ring when the linkage is in the unlocked position and the spindle is rotated about the axis of rotation. Also, the wedge pin and the lock ring are configured to non-moveably engage each other when the linkage is in the locked position, and the wedge pin and the lock ring are configured to moveably engage each other when the linkage is in the unlocked position. The dial also comprises and actuator including (E) a button slidably engaging the knob, wherein the button is configured to move substantially transverse to the axis of rotation, and (F) an actuator shaft coupled to the button for movement therewith, wherein the actuator shaft includes a second sloped surface engaging the first sloped surface of the linkage, and wherein the actuator shaft extends from the button through the knob to a position proximate the axis of rotation. Also, the second sloped surface of the actuator shaft is configured to exert force on the first sloped surface of the linkage in response to movement of the button substantially transverse to the axis of rotation, and the linkage is configured to move along the axis of rotation to the unlocked position in response to the second sloped surface exerting force on the first sloped surface.

In another example, the dial described in the preceding paragraph further comprises a spindle base interposed between the threaded spindle and the seat, the spindle base coupled to the seat and including a sidewall extending away from the device, the sidewall defining a recess into which the spindle nests; and a retaining nut coupled to the spindle base to retain a portion of the spindle between the retaining nut and the spindle base to constrain the spindle from traveling along the axis of rotation but permitting the spindle to rotate about the axis of rotation.

The terms and descriptions used above are set forth by way of illustration only and are not meant as limitations. Those skilled in the art will recognize that many variations can be made to the details of the above-described embodiments without departing from the underlying principles of the invention. The scope of the present invention should, therefore, not be limited to the above specific examples, but is defined by the claims below.

The invention claimed is:

1. An auto-locking adjustment device for an optical device, comprising:

an engagement surface fixed relative to the optical device;

a spindle rotatably supported on the optical device for rotation about an axis and relative to the optical device and the engagement surface, the spindle operatively coupled to an adjustable portion of the optical device to thereby adjust the adjustable portion in response to rotation of the spindle;

a locking mechanism carried by the spindle for rotation therewith, the locking mechanism switchable between a locked condition and an unlocked condition; and a button carried by the spindle for rotation therewith and manually depressible transverse to the axis, the button mechanically driving the locking mechanism such that manually depressing the button switches the locking mechanism from the locked condition, wherein the locking mechanism interlocks with the engagement surface and prevents rotation of both the spindle and the button relative to the optical device, to the unlocked condition, wherein both the spindle and the button are rotatable about the axis relative to the optical device and the engagement surface.

2. The adjustment device of claim 1, further comprising a linkage carried by the spindle for rotation therewith and moveable along the axis relative to the spindle in response to depressing and releasing the button, to thereby switch the locking mechanism between the locked and unlocked conditions.

3. The adjustment device of claim 1, further comprising a means for biasing the locking mechanism to the locked condition, the means for biasing being opposed by depressing the button.

4. The adjustment device of claim 1, wherein:

the engagement surface includes multiple regularly spaced detents; and when the locking mechanism is in the unlocked condition, a portion of the locking mechanism rides across the detents as the spindle is rotated to provide tactile feedback indicating the extent of rotation of the spindle.

5. The adjustment device of claim 1, wherein the locking mechanism includes:

a linkage coupled to the spindle for rotation therewith and moveable along the axis of rotation relative to the spindle between the locked condition and the unlocked condition;

a wedge pin carried by the spindle for rotation therewith and slidably mounted to the spindle for movement relative to the spindle transverse to the axis; and wherein the linkage bears against the wedge pin when the linkage is in the locked condition to prevent the wedge pin from moving relative to the spindle and the engagement surface, to thereby prevent the spindle from rotating relative to the optical device.

6. The adjustment device of claim 5, further comprising a means for biasing the linkage into the locked condition.

7. The adjustment device of claim 5, further comprising a means for biasing the wedge pin toward the engagement surface.

8. The adjustment device of claim 5, wherein the locking mechanism further includes a locking pin having a groove that aligns with the wedge pin when the linkage is in the unlocked condition, the groove receiving a portion of the wedge pin as the spindle is rotated.

9. The adjustment device of claim 1, wherein the spindle is constrained from moving along the axis.

10. The adjustment device of claim 1, further comprising a mechanical coupling operatively connected to the spindle and constrained so that rotation of the spindle about the axis causes the mechanical coupling to move along a predetermined path relative to the axis, and the mechanical coupling couples the spindle to the adjustable portion of the optical device to thereby adjust a position of the adjustable portion of the optical device in response to rotation of the spindle.

11. The adjustment device of claim 1, further comprising a plunger threadably attached to the spindle and restrained from rotating about the axis relative to the optical device, such that rotation of the spindle about the axis causes the plunger to translate linearly along the axis, the plunger bearing against the adjustable portion of the optical device.

12. An optical device including the adjustment device of claim 11, wherein the optical device is a weapon aiming device comprising:

an outer tube on which the adjustment device is mounted; and the adjustable portion, including an inner tube positioned within the outer tube and movable therein, and the plunger drives movement of the inner tube in response to rotation of the spindle, to thereby adjust an elevation or windage of the weapon aiming device.

13. The adjustment device of claim 1, wherein the button includes:

a first button and a second button opposing the first button, wherein the first and second buttons are moved toward each other when manually depressed and are biased away from each other.

14. The adjustment device of claim 13, further comprising an actuator shaft attached to each of the first and the second buttons and extending toward the axis, wherein each actuator shaft includes a sloped surface that bears against the locking mechanism to drive the locking mechanism.

15. The adjustment device of claim 14, wherein each of the first and the second actuator buttons must be depressed radially toward the axis such that an outer surface of each button is located inward of an outer surface of the spindle to switch the locking mechanism to the unlocked condition.

16. The adjustment device of claim 14, wherein the two actuator shafts are linearly aligned with each other.

17. The adjustment device of claim 14, wherein the two actuator shafts are offset from each other.

18. The adjustment device of claim 1, further comprising a knob installed over the spindle and coupled to the spindle for rotation therewith, and wherein the button is slidably supported on the knob.

19. The adjustment device of claim 18, further comprising an indicator ring mounted on the knob for rotation therewith to provide a visual indication of the amount of rotation of the knob, and wherein the knob is selectively coupled to the spindle for selecting either rotation with the spindle or rotation relative to the spindle.

20. The adjustment device of claim 19, further comprising a set screw selectively securing the knob to the spindle.

21. The adjustment device of claim 18, further comprising an actuator shaft attached to the button and extending from the button through a bore in the knob to a position proximate the axis.

22. The adjustment device of claim 1, further comprising a rotation- limiting adjustment stop that is movable relative to the spindle between a stop position and a non-stop position, wherein the rotation-limiting adjustment stop limits rotation of the spindle to one full rotation when the rotation-limiting adjustment stop is in the stop position.

23. An optical device inc tiding the adjustment device of claim 1.

24. An auto-locking adjustment device for an optical device, comprising:

an engagement surface fixed relative to the optical device;

a spindle rotatably supported on the optical device for rotation about an axis and relative to the optical device and the engagement surface, the spindle operatively coupled to an adjustable portion of the optical device to thereby adjust the adjustable portion in response to rotation of the spindle;

a locking mechanism carried by the spindle for rotation therewith, the-locking mechanism switchable between a locked condition and an unlocked condition;

a first and an opposing second button attached to the spindle for rotation therewith and manually depressible transverse to the axis, wherein the first and second buttons are moved toward each other when manually depressed and are biased away from each other, at least one of the first and second buttons mechanically driving the locking mechanism such that manually depressing the at least one of the first and second buttons switches the locking mechanism from the locked condition, wherein the locking mechanism interlocks with the engagement surface and prevents rotation of both the spindle and the button relative to the optical device, to the unlocked condition, wherein both the spindle and button are rotatable about the axis relative to the optical device and the engagement surface; and an actuator shaft attached to each of the first and the second buttons and extending toward the axis, wherein each actuator shaft includes a sloped surface that bears against the locking mechanism to drive the locking mechanism.

25. An auto-locking adjustment device for an optical device, comprising:

an engagement surface fixed relative to the optical device;

a spindle rotatably supported on the optical device for rotation about an axis and relative to the optical device and the engagement surface, the spindle operatively coupled to an adjustable portion of the optical device to thereby adjust the adjustable portion in response to rotation of the spindle;

a locking mechanism carried by the spindle for rotation therewith, the locking mechanism switchable between a locked condition and an unlocked condition;

a knob installed over the spindle and coupled to the spindle for rotation therewith;

a button carried by the spindle for rotation therewith and slidable supported on the knob, the button manually depressible transverse to the axis, the button mechanically driving the locking mechanism such that manually depressing the button switches the locking mechanism from the locked condition, wherein the locking mechanism interlocks with the engagement surface and prevents rotation of both the knob and the button relative to the optical device, to the unlocked condition, wherein both the knob and the button are rotatable about the axis relative to the optical device and the engagement surface; and an actuator shaft attached to the button and extending from the button through a bore in the knob to a position proximate the axis.

* * * * *

UNITED STATES PATENT AND TRADEMARK OFFICE

CERTIFICATE OF CORRECTION

PATENT NO. : 9,188,408 B2
APPLICATION NO. : 12/938981
DATED : November 17, 2015
INVENTOR(S) : Xuyen Huynh It is certified that error appears in the above-identified patent and that said Letters Patent is hereby corrected as shown below:

Specification

In column 1, line 25, change "device" to --devices--.

In column 2, line 29, change "(b) to engage" to --(b) engage--.

In column 4, line 22, change "100 may be also be used" to --100 may also be used--.

In column 4, line 63, delete ", for example,".

In column 8, line 15, change "help" to --helps--.

In column 9, line 2, after "both", insert --,--.

In column 10, line 6, change "knob, for example," to --knob. For example,--.

In column 11, line 62, change "describe" to --described--.

In column 14, line 21, change "optional, for example," to --optional. For example,--.

In column 14, lines 66-67, change "and actuator" to --an actuator--.

Claims

In column 17, line 29, claim 22 change "rotation- limiting" to --rotation-limiting--.

In column 17, line 34, claim 23 change "inc tiding" to --including--.

In column 17, line 46, claim 24 change "the-locking" to --the locking--.

In column 18, line 35, claim 25 change "slidable" to --slidably--.

Signed and Sealed this
Twenty-first Day of June, 2016

Michelle K. Lee

Michelle K. Lee
*Director of the United States Patent and Trademark Office*